US010519640B2

(12) United States Patent
Tanimoto et al.

(10) Patent No.: US 10,519,640 B2
(45) Date of Patent: Dec. 31, 2019

(54) DISCHARGE VALVE OPERATING DEVICE, FLUSH WATER TANK DEVICE, AND TOILET SYSTEM

(71) Applicant: TOTO LTD., Kitakyushu-shi, Fukuoka (JP)

(72) Inventors: Hideki Tanimoto, Kitakyushu (JP); Tomoyoshi Taketani, Kitakyushu (JP); Takashi Matsusaki, Kitakyushu (JP)

(73) Assignee: TOTO LTD., Kitakyushu-shi, Fukoka (JP)

( * ) Notice: Subject to any disclaimer, the term of this patent is extended or adjusted under 35 U.S.C. 154(b) by 0 days.

(21) Appl. No.: 15/879,357

(22) Filed: Jan. 24, 2018

(65) Prior Publication Data

US 2018/0216329 A1 Aug. 2, 2018

(30) Foreign Application Priority Data

Jan. 30, 2017 (JP) ..... 2017-014683

(51) Int. Cl.

| | |
|---|---|
| ***E03D 1/34*** | (2006.01) |
| ***E03D 5/10*** | (2006.01) |
| ***E03D 1/012*** | (2006.01) |
| ***E03D 1/35*** | (2006.01) |
| ***E03D 1/33*** | (2006.01) |
| ***E03D 1/14*** | (2006.01) |
| *E03D 1/32* | (2006.01) |

(52) U.S. Cl.

CPC ..... *E03D 1/34* (2013.01); *E03D 1/0125* (2013.01); *E03D 1/144* (2013.01); *E03D 1/33* (2013.01); *E03D 1/35* (2013.01); *E03D 5/10* (2013.01); *E03D 1/32* (2013.01)

(58) Field of Classification Search

CPC ..... E03D 5/10; E03D 1/34; E03D 1/0125; E03D 1/144

USPC ..... 4/324, 325

See application file for complete search history.

(56) References Cited

U.S. PATENT DOCUMENTS 4,969,218 A * 11/1990 Comparetti ..... E03D 1/144 4/324

5,669,082 A * 9/1997 Sun ..... E03D 1/144 4/324

(Continued)

FOREIGN PATENT DOCUMENTS

CN 2651312 Y 10/2004

*Primary Examiner* — Janie M Loeppke

(74) *Attorney, Agent, or Firm* — BakerHostetler

(57) ABSTRACT

A discharge valve operating device includes a first linking member and a second linking member, a rotary winding device, and an operation unit configured to rotationally operate the rotary winding device, wherein when the operation unit rotationally operates in a first direction, the operation unit is configured to perform toilet flushing in a full-flushing mode by pulling up the discharge valve by a first length by the rotary winding device winding the first linking member by the first length in the first direction, and when the operation unit rotationally operates in a second direction opposite to the first direction, the operation unit is configured to perform toilet flushing in a partial-flushing mode by pulling up the discharge valve by a second length by the rotary winding device winding the second linking member in the second direction by the second length which is the same as the first length.

7 Claims, 16 Drawing Sheets

(56) References Cited

U.S. PATENT DOCUMENTS

| | | | | |
|---|---|---|---|---|
| 5,960,482 | A * | 10/1999 | Chang | E03D 1/308 4/325 |
| 2014/0123378 | A1 * | 5/2014 | Luettgen | B23P 19/00 4/406 |

* cited by examiner

S0 , S2 , S3 , S5 , S6

S0 , S2 , S3 , S5 , S6

DISCHARGE VALVE OPERATING DEVICE, FLUSH WATER TANK DEVICE, AND TOILET SYSTEM

TECHNICAL FIELD

The present invention relates to a discharge valve operating device, a flush water tank device, and a toilet system, and particularly relates to a discharge valve operating device that performs a valve opening operation of a discharge valve of a flush water tank device that supplies flush water to a toilet, a flush water tank device, and a toilet system.

BACKGROUND

As a discharge valve operating device that performs a valve opening operation of a discharge valve of a flush water tank device that supplies flush water to a toilet, there has been known a discharge valve operating device in which an operation handle is rotationally operated in a predetermined direction manually, whereby a common rotary winding member is rotationally operated in a predetermined direction, the rotary winding member winds up a single operation wire connected to a discharge valve, and a valve opening operation is performed, as described in Patent Literature 1 (Japanese Patent Unexamined Publication No. 2014-190131).

Further, in a conventional discharge valve operating device described in Patent Literature 2 (Japanese Patent Unexamined Publication No. 2015-196949), there is also known the device that enables a valve opening operation by manually pulling up a single common operation wire linked to a discharge valve by a manual operation unit, and enables a valve opening operation by automatically pulling up a single common operation wire by an electric drive unit.

Further, in the conventional discharge valve operating device described in Patent Literature 2, a pulling-up amount of the operation wire is set to be large when a full-flushing mode in which a flush water amount is large is executed, and the pulling-up amount of the operation wire is set to be smaller than the pulling-up amount in the full-flushing mode when a partial-flushing mode in which the flush water amount is small is executed.

However, in recent years, in order to pursue ease of use of the discharge valve operating device, automation of the valve opening operation of a discharge valve has been realized by electrification of the operation itself of the discharge valve operating device or the like, without sticking to a direct manual operation by a user, and it has been a problem requested to be solved in recent years how to switch a flushing mode with an easy operation to perform a valve opening operation accurately.

Accordingly, the present invention is made to solve the problem requested to be solved in the aforementioned prior art, and has an object to provide a discharge valve operating device that can accurately perform a valve opening operation by switching a flushing mode with an easy operation, a flush water tank device, and a toilet system.

SUMMARY

In order to solve the aforementioned problem, the present invention provides a discharge valve operating device configured to perform a valve opening operation of a discharge valve disposed in a flush water tank device configured to supply flush water to a toilet, the discharge valve operating device comprising: a first linking member and a second linking member including respective one ends linked to the discharge valve; a rotary winding device to which respective other ends of the first linking member and the second linking member are linked; and an operation unit configured to rotationally operate the rotary winding device, wherein when the operation unit rotationally operates in a first direction in a first flushing mode, the operation unit is configured to supply flush water from the flush water tank device to the toilet by a first flush water amount by pulling up the discharge valve by a first length by the rotary winding device which winds the first linking member by the first length in the first direction, and when in a second flushing mode the operation unit rotationally operates in a second direction opposite to the first direction, the operation unit is configured to supply flush water from the flush water tank device to the toilet by a second flush water amount different from the first flush water amount by pulling up the discharge valve by a second length by the rotary winding device which winds the second linking member in the second direction by the second length which is the same as the first length.

According to the invention described above, when the operation unit is simply operated rotationally by the same rotational operation amount in the different direction in accordance with the desired flushing mode at the time of executing each of the first flushing mode and the second flushing mode in which the flush water amounts are different respectively, the flushing mode can be switched to the different flushing mode easily by using the common rotary winding device.

Further, the rotary winding device winds either one of the first linking member or the second linking member by the same amount in accordance with the flushing mode, whereby the valve opening operation of the constant pulling-up amount of the discharge valve can be accurately performed irrespective of the flushing mode, and toilet flushing in the different flushing mode can be easily executed.

In the present invention, it is preferable that the operation unit is an electric operation unit configured to electrically operate the discharge valve, the electric operation unit includes an electric rotating shaft configured to rotationally drive by electric power from an outside, and the electric rotating shaft is linked to the rotary winding device, and the rotary winding device is configured to rotate with a rotation radius larger than a rotation radius of the electric rotating shaft by rotational drive of the electric rotating shaft.

According to the invention described above, when the electric rotating shaft of the electric operation unit is rotationally operated in accordance with the desired flushing mode at the time of executing each of the first flushing mode and the second flushing mode in which the flush water amounts are different respectively, the rotary winding device can be rotated by the same rotation amount in the different direction in accordance with the desired flushing mode with the larger rotation radius than the rotation radius of the electric rotating shaft.

Accordingly, the rotary winding device can automatically wind either one of the first linking member or the second linking member by the same amount in accordance with the flushing mode. Thereby, the valve opening operation of the constant pulling-up amount of the discharge valve can be automatically performed irrespective of the flushing mode, and toilet flushing in the different mode can be easily executed automatically.

Further, the rotary winding device is rotatable with the larger rotation radius than the rotation radius of the electric rotating shaft, so that the rotary winding device can pull up either one of the first linking member or the second linking member with a relatively large pulling-up amount with respect to the rotation angle of the electric rotating shaft.

Consequently, the valve opening operation of the discharge valve can be efficiently performed.

In the present invention, it is preferable that an outer periphery of the rotary winding device includes a first mounting portion and a second mounting portion to which the respective other ends of the first linking member and the second linking member are mounted, and the respective mounting portions are disposed substantially in parallel in a direction of a rotation central axis of the rotary winding device, the first linking member and the second linking member are disposed symmetrically to each other at one side and the other side with respect to a rotation center of the rotary winding device in plan view of the rotary winding device, a standby position of the first mounting portion of the rotary winding device and the other end of the first linking member in a state before start of an electric operation of the electric operation unit is set at a position where the first linking member is wound in advance by a predetermined length along the outer periphery of the rotary winding device in the first direction, and a standby position of the second mounting portion of the rotary winding device and the other end of the second linking member in the state before start of the electric operation of the electric operation unit is set at a position where the second linking member is wound in advance by the predetermined length along the outer periphery of the rotary winding device in the second direction.

According to the invention described above, when the electric rotating shaft of the electric operation unit is rotationally operated in the first direction from the state before start of the electric operation of the electric operation unit first, the rotary winding device rotates in the first direction from the standby state, and the first mounting portion and the second mounting portion move by the first length in the first direction from the standby position. Thereby, the first linking member is further wound by the first length in the first direction from the standby position by the rotary winding device, whereas the second linking member is unwound by the first length in the first direction from the standby position by the rotary winding device.

When the electric rotating shaft of the electric operation unit is rotationally operated in the second direction, the rotary winding device rotates in the second direction from the standby state, and the first mounting portion and the second mounting portion move by the second length which is the same as the first length in the second direction from the standby position. Thereby, the first linking member is unwound by the second length in the second direction from the standby position by the rotary winding device, whereas the second linking member is further wound by the second length in the second direction from the standby position by the rotary winding device.

Accordingly, the rotary winding device can automatically wind either one of the first linking member or the second linking member by the same amount in accordance with the flushing mode smoothly, and the valve opening operation of the constant pulling-up amount of the discharge valve can be automatically performed reliably irrespective of the flushing mode.

Further, the respective mounting portions are disposed substantially in parallel in the direction of the rotation central axis of the rotary winding device. The first linking member and the second linking member are disposed symmetrically to each other at one side and the other side with respect to the rotation center of the rotary winding device in plan view of the rotary winding device, so that even when the rotary winding device rotates in accordance with the flushing mode, the first linking member and the second linking member can move reliably and smoothly without interfering with each other.

In the present invention, it is preferable that a first lever configured to indirectly link the discharge valve and the one end of the first linking member, and a second lever configured to indirectly link the discharge valve and the one end of the second linking member, wherein the first lever includes a first linking portion configured to slidably hold the first linking member and to link the other end of the first linking member engageably and disengageably, and the second lever includes a second linking portion configured to slidably hold the second linking member and to link the other end of the second linking member engageably and disengageably.

According to the invention described above, when the rotary winding device rotates in the first direction from the standby state by the rotational operation in the first direction of the electric operation unit first, the first linking member is wound by the first length by the rotary winding device. Thereby, the first linking member, the first lever and the discharge valve rise by the first length in the state where the one end of the first linking member and the first linking portion are engaged with each other.

At the same time, the second linking member is unwound by the first length by the rotary winding device, and the second linking member lowers by the first length in the state where engagement of the one end of the second linking member and the second linking portion is released.

Thereby, the second lever is not pulled up, but the first lever is pulled up by the first linking member, and the valve opening operation by the first flushing mode of the discharge valve can be accurately executed.

When the rotary winding device rotates in the second direction from the standby state by the rotational operation in the second direction of the electric operation unit, the second linking member is wound by the second length which is the same as the first length by the rotary winding device. Thereby, the second linking member, the second lever and the discharge valve rise in the state where the one end of the second linking member and the second linking portion are engaged with each other.

At the same time, the first linking member is unwound by the second length by the rotary winding device, and the first linking member lowers by the second length in the state where engagement of the one end of the first linking member and the first linking portion is released.

Thereby, only the second lever is pulled up by the second linking member, and the valve opening operation by the second flushing mode of the discharge valve can be accurately executed.

In the present invention, it is preferable that the discharge valve operating device further includes a holding device configured to rotatably hold the rotary winding device, wherein the rotary winding device and the holding device include a rotating angle limiting device configured to limit a rotation angle of the rotary winding device.

According to the invention described above, the rotating angle limiting device that limits the rotation angle of the rotary winding device is provided in the rotary winding device and the holding device, whereby the range of the rotation angle of the rotary winding device which is rotationally operated in the first direction or the second direction in accordance with the flushing mode can be limited within the range of a predetermined angle.

Accordingly, the pulling-up amount of the discharge valve at the time of the valve opening operation can be accurately controlled.

Further, the present invention further provides a flush water tank device including the discharge valve operating device.

According to the invention described above, the flush water tank device that can accurately perform the valve opening operation of the constant pulling-up amount of the discharge valve irrespective of the flushing mode, and can easily execute toilet flushing in the different flushing modes can be provided.

Further, the present invention provides a toilet system including the flush water tank device, and a flush toilet connected to the flush water tank device.

According to the invention described above, the toilet system that can accurately perform the valve opening operation of the constant pulling-up amount of the discharge valve irrespective of the flushing mode, and can easily execute toilet flushing in the different flushing modes can be provided.

According to the discharge valve operating device, the flush water tank device and the toilet system of the present invention, the flushing mode is switched with an easy operation, and the valve opening operation can be performed accurately.

DETAILED DESCRIPTION

Hereinafter, a discharge valve operating device according to one embodiment of the present invention will be described with reference to the accompanying drawings.

First, based on FIG. 1, an outline of a toilet system including a flush water tank device to which the discharge valve operating device according to one embodiment of the present invention is applied will be described.

Figure 1:
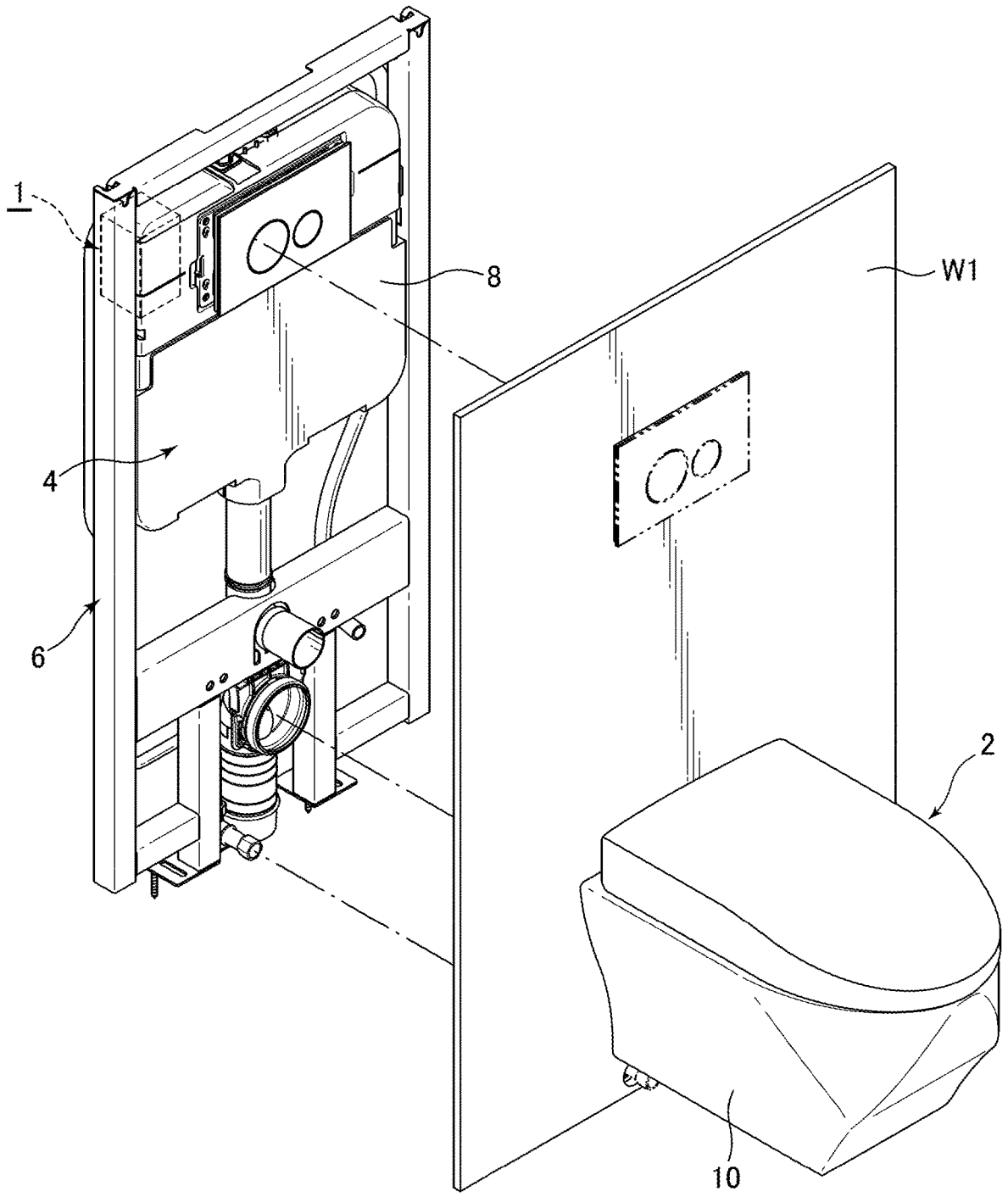
FIG. 1 is a schematic exploded perspective view illustrating a toilet system including a flush water tank device to which a discharge valve operating device according to one embodiment of the present invention is applied.

FIG. 1 is a schematic exploded perspective view illustrating the toilet system including the flush water tank device to which the discharge valve operating device according to one embodiment of the present invention is applied.

As illustrated in FIG. 1, a discharge valve operating device 1 according to one embodiment of the present invention is provided in a flush water tank device 4 that supplies flush water to a wall-mounted type flush toilet 2 of a toilet system T.

Both left and right sides of the flush water tank device 4 are fixed by a fixing device 6 that fixes a rear end portion of the flush toilet 2 of the toilet system T from a wall back side via a wall W1.

Further, the flush water tank device 4 includes a gravity water supply type water storage tank 8 that is hidden in a back side region of the wall W1, and supplies flush water to the flush toilet 2 by using the gravity for the flush water in the water storage tank 8.

As for the wall-mounted type flush toilet 2, application may be made to a so-called wash-down type toilet in which flush water supplied from the flush water tank device 4 discharges excrement by a drop in a height direction of a bowl portion (not illustrated) in a toilet body 10, or application can be made to flush toilets of various modes such as a so-called siphon type toilet that sucks excrement in a bowl portion (not illustrated) and discharges the excrement at once from a drain trap conduit (not illustrated) by using a siphon action.

Figure 2:
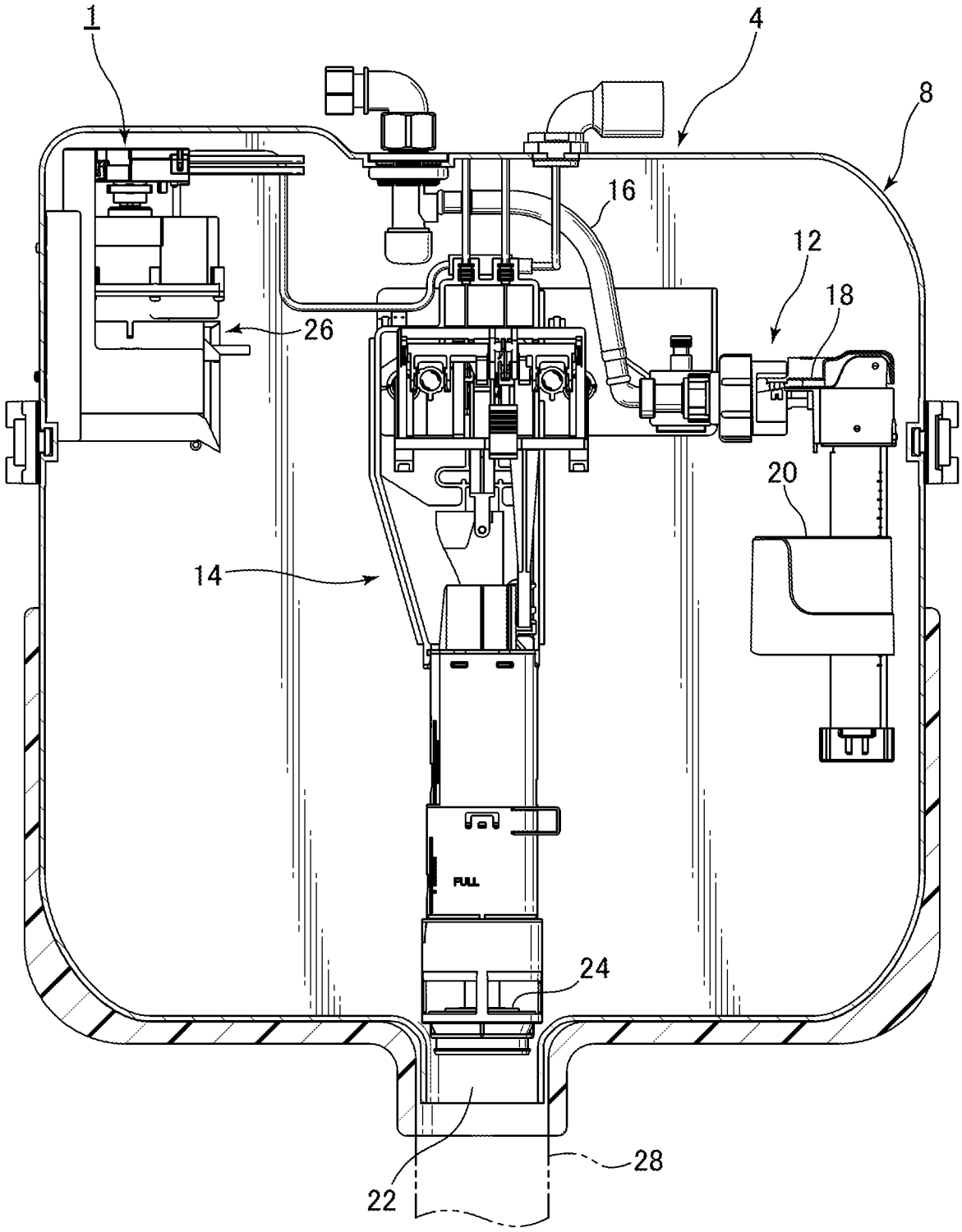
FIG. 2 is a schematic front view illustrating an internal structure of the flush water tank device to which the discharge valve operating device according to one embodiment of the present invention is applied.

Next, FIG. 2 is a schematic front view illustrating an internal structure of the flush water tank device to which the discharge valve operating device according to one embodiment of the present invention is applied.

As illustrated in FIG. 2, the discharge valve operating device 1, a water supply valve device 12, and a discharge valve device 14 of the present embodiment are respectively provided inside of the water storage tank 8 of the flush water tank device 4.

First, as illustrated in FIG. 2, the water supply valve device 12 includes a water supply pipe 16 that is connected to a water supply source (not illustrated) outside of the water storage tank 8, such as a city water, a water supply valve 18 that switches between water discharge and water stop of flush water that is supplied from the water supply pipe 16, and a float 20 that opens and closes the water supply valve 18 by moving up and down in accordance with a variation of a water level in the water storage tank 8.

Details of the water supply valve device 12 are similar to the conventional water supply valve device, so that explanation will be omitted.

Next, as illustrated in FIG. 2, the discharge valve device 14 includes a discharge valve body 24 that is a discharge valve that opens and closes a discharge port 22 in a bottom portion of the water storage tank 8 by moving up and down.

At a time of starting toilet flushing, a pulling-up operation (a valve opening operation) of the discharge valve body 24 is enabled by an electric operation of an electric operation unit 26 (details will be described later) that is an operation unit of the discharge valve operating device 1 of the present embodiment.

Further, as illustrated in FIG. 2, in a state where the discharge valve body 24 is opened, the flush water in the water storage tank 8 passes through an inside of a connecting pipe 28 at a lower part (a downstream side) of the discharge port 22 from the discharge port 22, and flows into a conduit (not illustrated) of the toilet body 10.

Next, with reference to FIGS. 3 to 9, details of the discharge valve operating device 1 according to one embodiment of the present invention and the discharge valve device 14 will be described.

Figure 3:
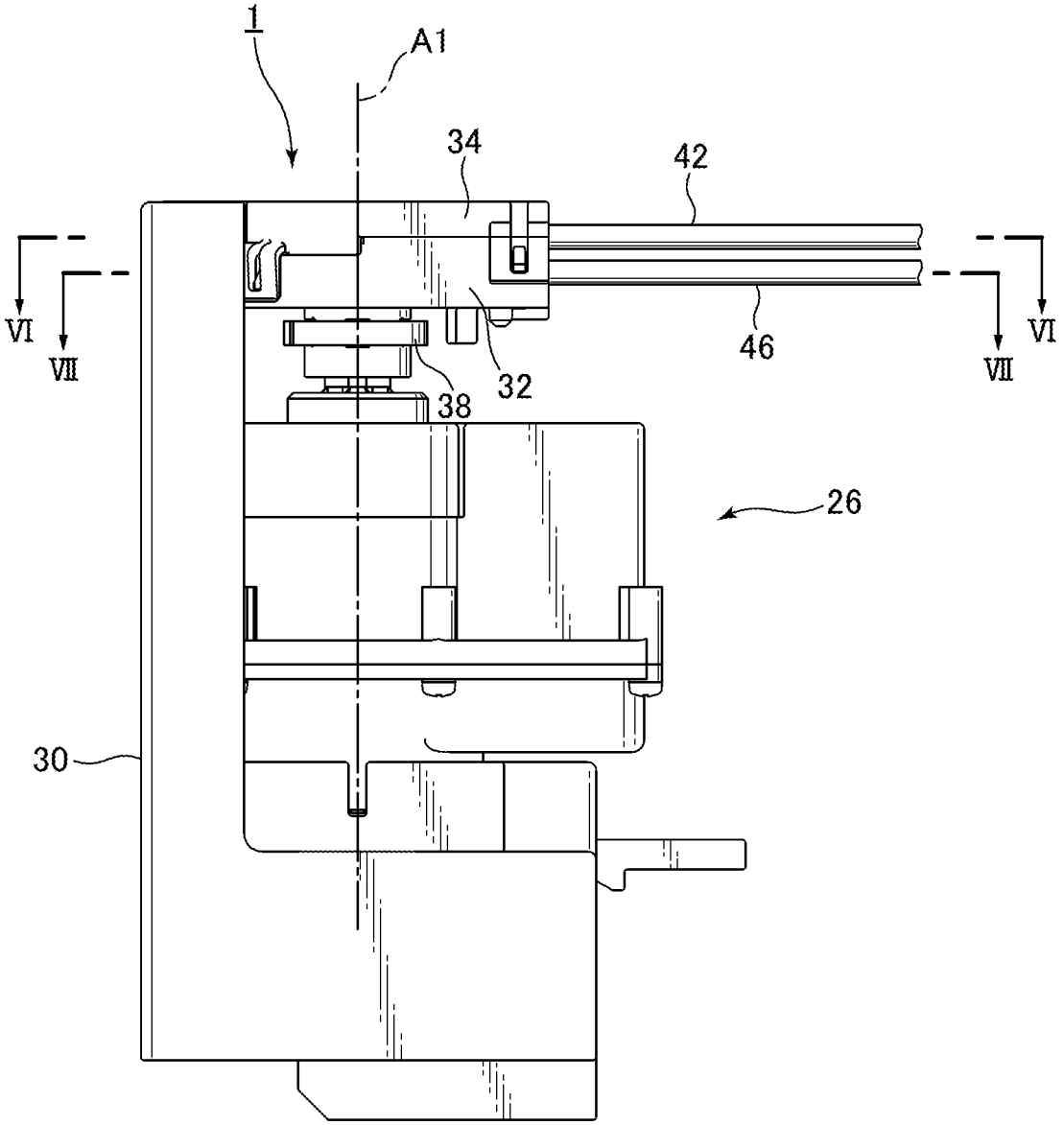
FIG. 3 is a schematic front view illustrating an electric operation unit of the discharge valve operating device according to one embodiment of the present invention.

FIG. 3 is a schematic front view illustrating an electric operation unit of the discharge valve operating device according to one embodiment of the present invention.

Figure 4:
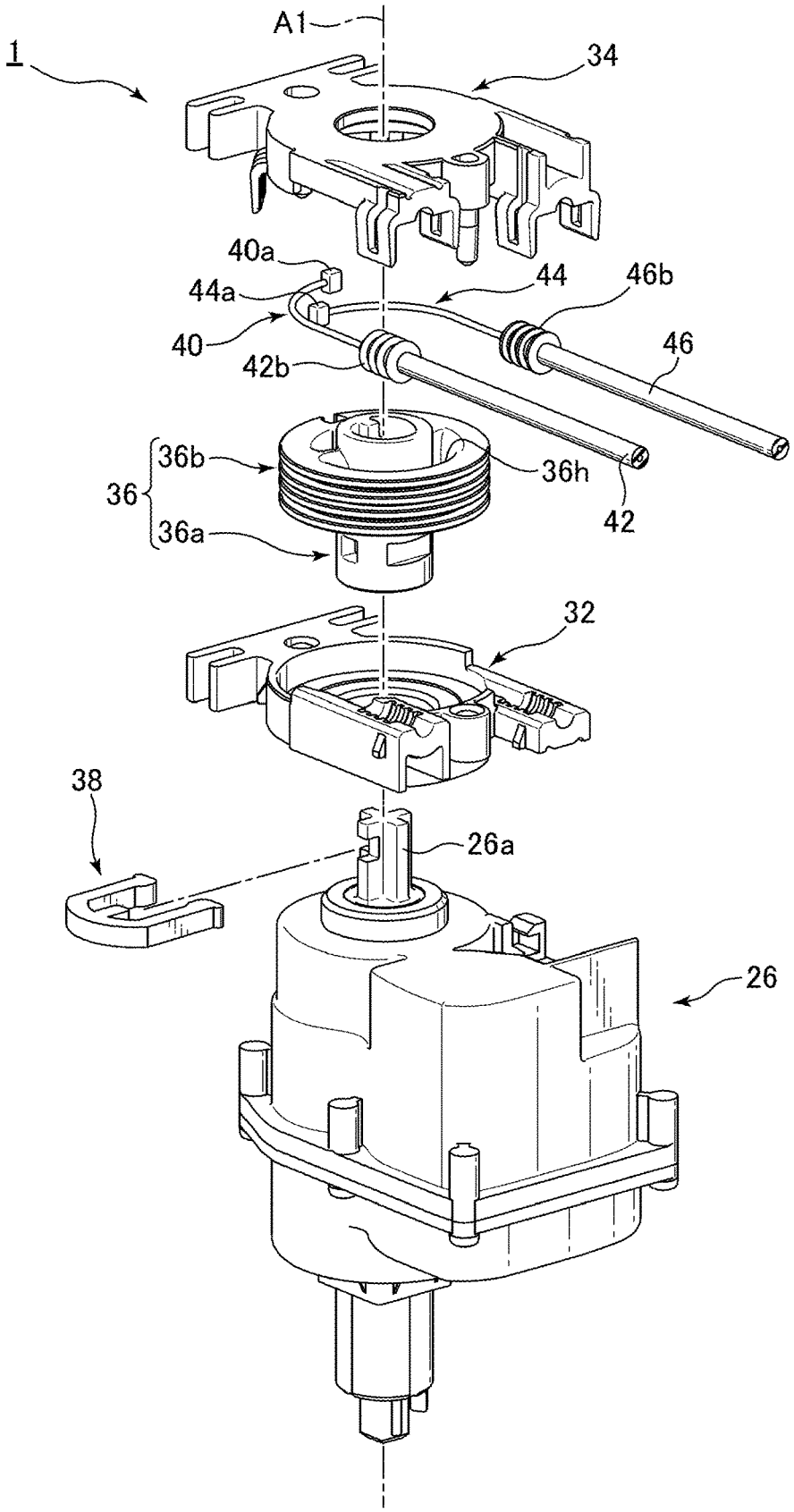
FIG. 4 is an exploded perspective view of the electric operation unit of the discharge valve operating device according to one embodiment of the present invention as seen obliquely from above.
Figure 5:
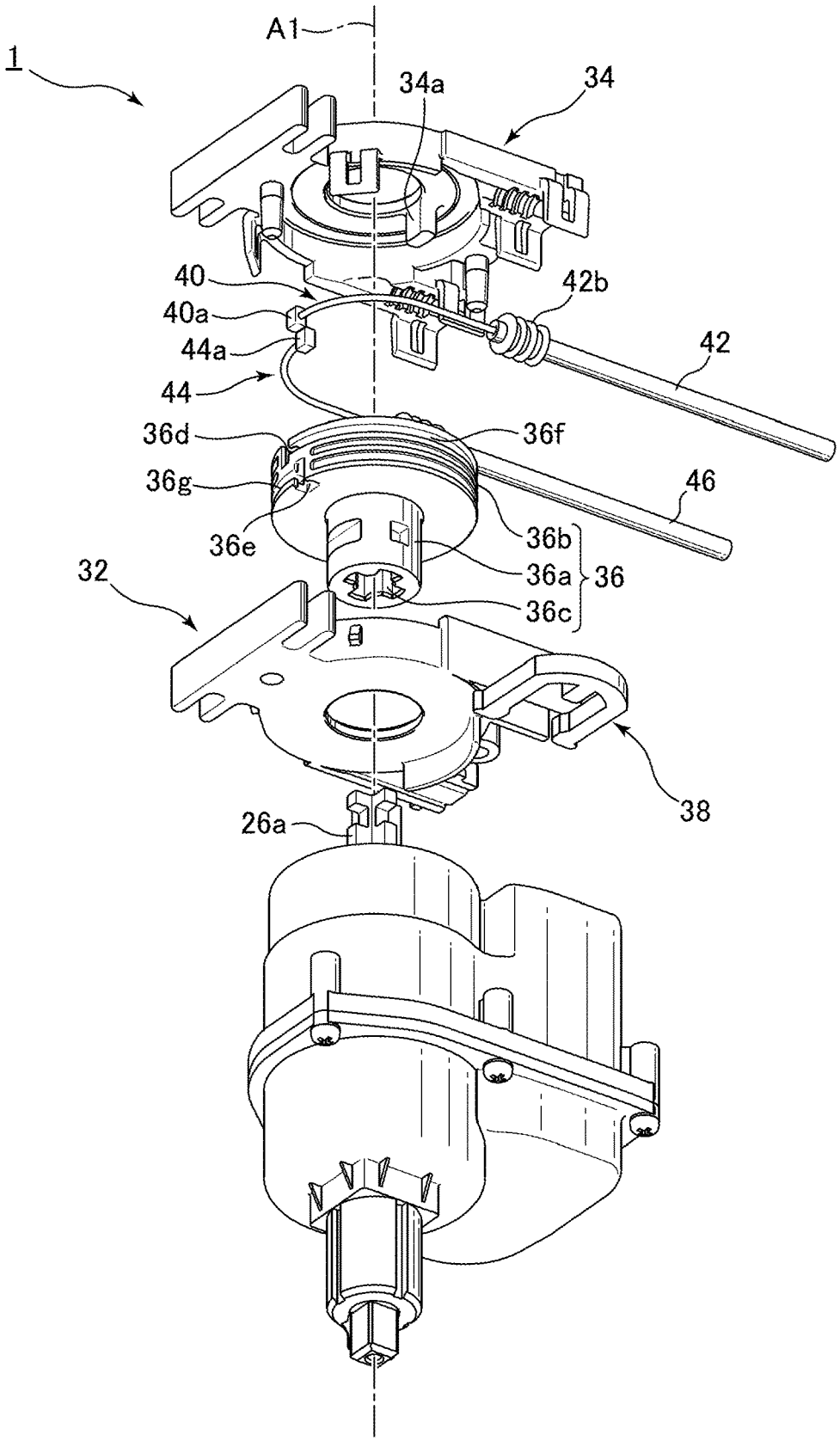
FIG. 5 is an exploded perspective view of the electric operation unit of the discharge valve operating device according to one embodiment of the present invention as seen obliquely from below.

FIG. 4 is an exploded perspective view of the electric operation unit of the discharge valve operating device according to one embodiment of the present invention as seen obliquely from above, and FIG. 5 is an exploded perspective view of the electric operation unit of the discharge valve operating device according to one embodiment of the present invention as seen from obliquely from below.

Figure 6:
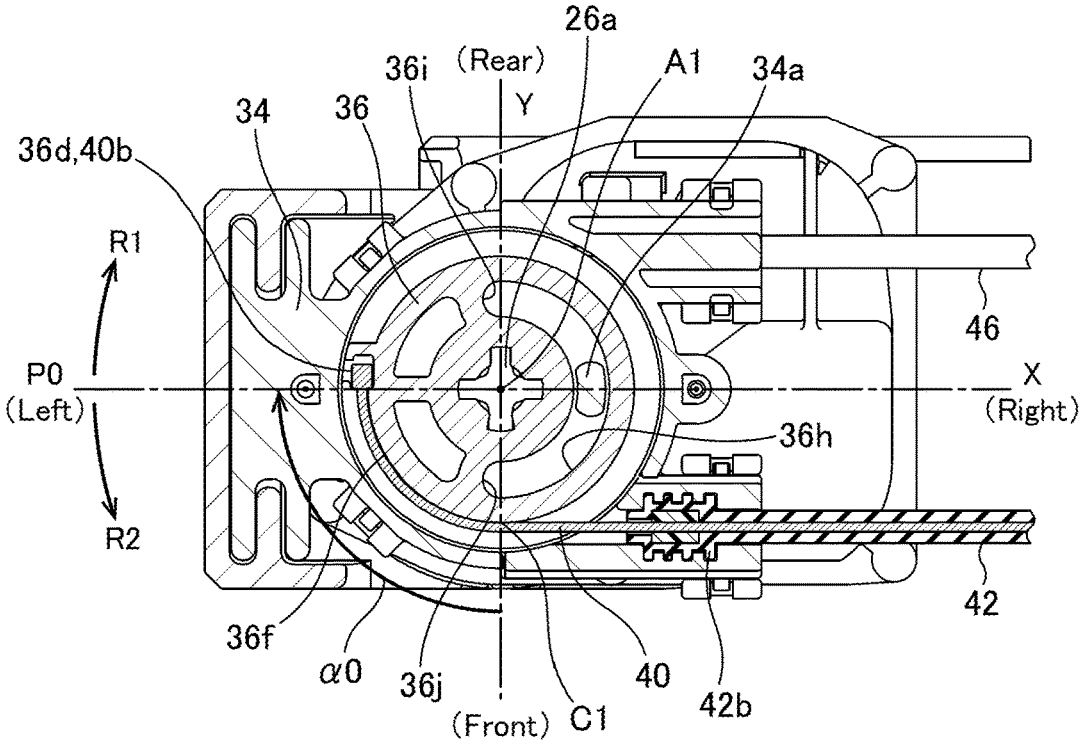
FIG. 6 is a sectional view taken along line VI-VI in FIG. 3.
Figure 7:
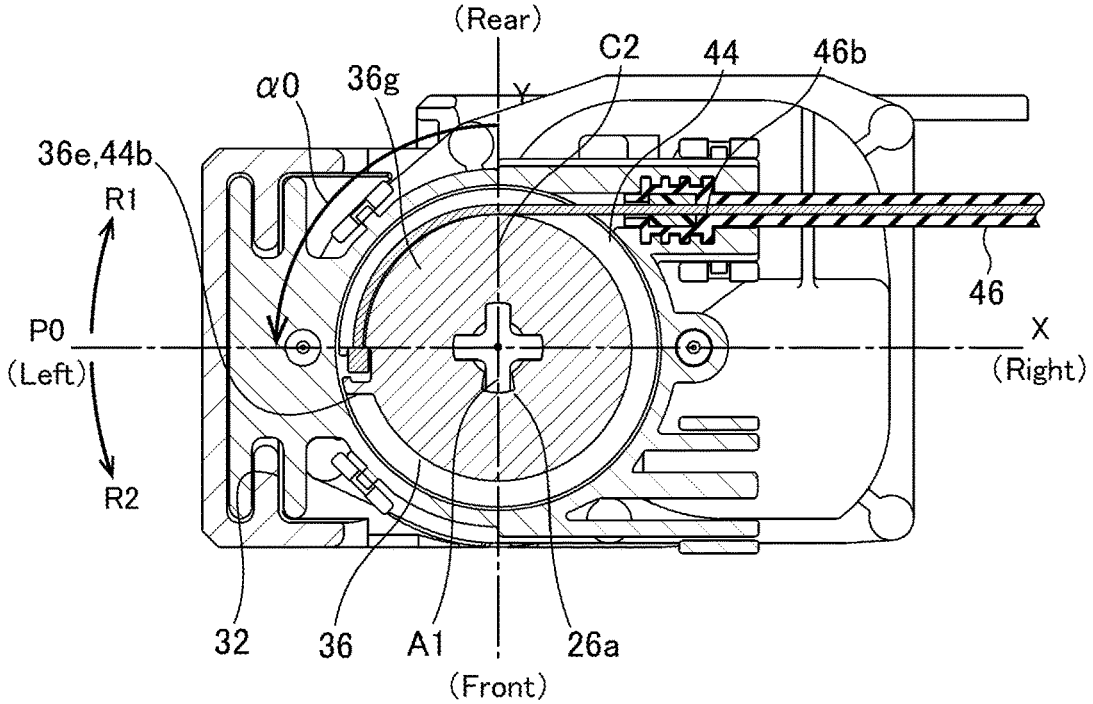
FIG. 7 is a sectional view taken along line VII-VII in FIG. 3.

Further, FIG. 6 is a sectional view taken along line VI-VI in FIG. 3, and FIG. 7 is a sectional view taken along line VII-VII in FIG. 3.

Figure 8:
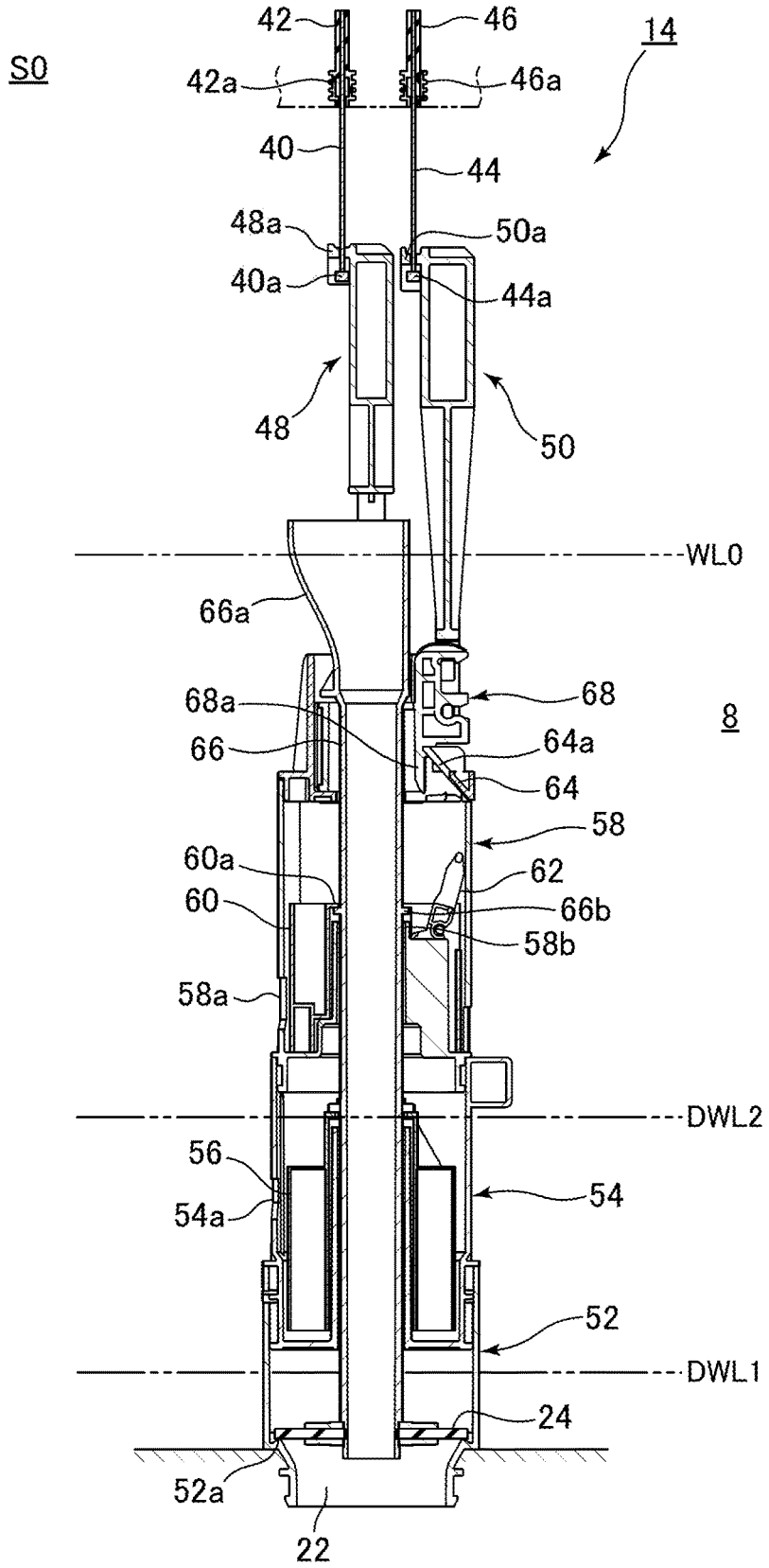
FIG. 8 is a schematic sectional front view of a discharge valve device that is operated by the discharge valve operating device according to one embodiment of the present invention, and illustrates a standby state (a closed valve state) before starting a valve opening operation.

Further, FIG. 8 is a schematic sectional front view of the discharge valve device that is operated by the discharge valve operating device according to one embodiment of the present invention, and illustrates a standby state (a closed valve state) before starting a valve opening operation.

First, as illustrated in FIGS. 3 to 7, the discharge valve operating device 1 according to the present embodiment includes the electric operation unit 26 which is fixed to an inside of the water storage tank 8 via a holder 30, upper and lower casings 32 and 34, a pulley 36, a fastener 38, an operation wire 40 for full-flushing mode that is a first connector or a first linking member, a protective tube 42 outside the operation wire 40, an operation wire 44 for partial-flushing mode that is a second connector or a second linking member, and a protective tube 46 outside of the operation wire 44.

The electric operation unit 26 contains a DC motor (not illustrated), a gearbox (not illustrated), an actuator (not illustrated) and the like, and includes an electric rotating shaft 26*a* capable of rotationally driving by electric power from an outside.

Further, in an operation of the electric operation unit 26, a controller (not illustrated) controls drive of the DC motor (not illustrated) and the actuator (not illustrated) and rotational drive of the electric rotating shaft 26*a* is controlled, based on, for example, a signal which a human sensor (not illustrated) installed in a periphery of the flush toilet 2 sends by sensing, and/or a signal which a user sends by operating a remote controller (not illustrated) or the like.

Further, the electric operation unit 26 is also provided with a return spring (not illustrated) or the like that urges the electric rotating shaft 26*a* in a direction to reverse the electric rotating shaft 26*a* to return the electric rotating shaft 26*a* to an initial position P0 reliably, after the electric rotating shaft 26*a* rotates by a predetermined rotation angle θ1 from the initial position P0.

Details of a structure of the electric operation unit 26 are similar to the conventional structure, so that explanation will be omitted.

In the present embodiment, a mode including both of the human sensor (not illustrated) and the remote controller (not illustrated) may be adopted, or either one of them is omitted, and based on a signal transmitted from only the other one, the controller (not illustrated) may actuate the electric rotating shaft 26*a* of the electric operation unit 26.

Next, as illustrated in FIGS. 4 to 7, the upper and lower casings 34 and 32 together define a casing and are holding devices that rotatably hold the pulley 36.

Further, the pulley 36 is a rotary winding member including a shaft portion 36*a* to which the electric rotating shaft 26*a* of the electric operation unit 26 is linked, and a rotary winding portion 36*b* in a substantially ring shape that projects outward in a radial direction from the shaft portion 36*a*.

In an interior of the shaft portion 36*a* of the pulley 36, a female hole 36*c* (refer to FIG. 5) is formed in an axial direction of the shaft portion 36*a*, and the electric rotating shaft 26*a* of the electric operation unit 26 can be inserted therein from a lower side.

Further, in a state where the electric rotating shaft 26*a* is inserted in the female hole 36*c* of the shaft portion 36*a* of the pulley 36, the fastener 38 is fitted in a predetermined position of an outer surface of the shaft portion 36*a* of the pulley 36 from outside, whereby the shaft portion 36*a* of the pulley 36 is fixed to the electric rotating shaft 26*a*, and is prevented from removing in an axial direction.

Further, as illustrated in FIG. 8, a projection 40*a* at one end of the operation wire 40 for full-flushing mode is linked to a first linking portion (a linking portion 48*a*) of a first lever (an operation lever 48 for full-flushing mode) of the discharge valve device 14 which will be described later in detail to be engageable and disengageable.

Likewise, a projection 44*a* at one end of the operation wire 44 for partial-flushing mode is linked to a second linking portion (a linking portion 50*a*) of a second lever (an operation lever 50 for partial-flushing mode) of the discharge valve device 14 which will be described in detail later to be engageable and disengageable.

A mounting hole 36*d* that is a first mounting portion and a mounting hole 36*e* (refer to FIG. 5) that is a second mounting portion are respectively provided on an outer peripheral surface of the rotary winding portion 36*b* of the pulley 36. Projections 40*b* and 44*b* at the other ends of the respective operation wires 40 and 44 are respectively fitted in the respective mounting holes 36*d* and 36*e* (refer to FIG. 5) of the rotary winding portion 36*b* of the pulley 36.

As illustrated in FIG. 5, the respective mounting holes 36*d* and 36*e* of the rotary winding portion 36*b* are disposed substantially in parallel in a rotation axis A1 direction of the rotary winding portion 36*b*. The mounting hole 36*d* to which the projection 40*b* of the operation wire 40 for full-flushing mode is mounted is located in an upper part and the mounting hole 36*e* to which the projection 44*b* of the operation wire 44 for partial-flushing mode is mounted is located in a lower part.

Further, as illustrated in FIG. 5, guide grooves 36*f* and 36*g* are respectively formed vertically in parallel throughout a substantially entire circumference except for the respective mounting holes 36*d* and 36*e* on an outer peripheral surface of the rotary winding portion 36*b* of the pulley 36. The respective operation wires 40 and 44 are guided along the corresponding guide grooves 36*f* and 36*g* when the operation wires 40 and 44 are wound by the rotary winding portion 36*b*.

The respective operation wires 40 and 44 are slidable with respect to the respective protective tubes 42 and 46 corresponding to the respective operation wires 40 and 44.

As illustrated in FIG. 8, respective one ends 42*a* and 46*a* of the respective protective tubes 42 and 46 are fixed to an upper portion of the discharge valve device 14 respectively.

As illustrated in FIGS. 4 to 7, the respective other ends 42*b* and 46*b* of the respective protective tubes 42 and 46 are fixed by being sandwiched from above and below by the casings 32 and 34.

Next, in FIGS. 6 and 7, a left-right direction axis passing through a rotation central axis A1 of the pulley 36 is set as "X", and a front-rear direction axis passing through the rotation central axis A1 of the pulley 36 is set as "Y".

As illustrated in FIGS. 6 and 7, the respective other ends 42*b* and 46*b* of the respective protective tubes 42 and 46 are disposed symmetrically to each other with respect to the rotation central axis A1 of the pulley 36 and the axis X, in plan view, and are located respectively at a front side and a rear side.

Accordingly, as illustrated in FIGS. 6 and 7, the operation wire 40 for full-flashing mode and the operation wire 44 for partial-flushing mode are also disposed symmetrically to each other with respect to the rotation central axis A1 of the pulley 36 and the axis X, and are located respectively at the front side and the rear side.

Further, as illustrated in FIG. 6, in a standby state S0 before an electric operation of the electric operation unit 26 is started, the operation wire 40 for full-flushing mode is in a state where the operation wire 40 is wound in advance by a predetermined length $\alpha 0$ in a first direction R1 along the guide groove 36*f* from a contacting point C1 with the guide groove 36*f*.

That is, as illustrated in FIG. 6, a standby position P0 of each of the first mounting hole 36*d* of the rotary winding portion 36*b* and the projection 40*b* of the operation wire 40 is set at a position where the operation wire 40 is wound in advance by the predetermined length $\alpha 0$ in the first direction R1 along the guide groove 36*f* from the contacting point C1 with the guide groove 36*f*.

Further, as illustrated in FIG. 6, the predetermined length $\alpha 0$ by which the operation wire 40 is wound in advance is approximately a quarter of an entire circumference (circular arc) length of the guide groove 36*f*.

Likewise, as illustrated in FIG. 7, the operation wire 44 for partial-flushing mode is in a state where the operation wire 44 is wound in advance by the predetermined length $\alpha 0$ in a second direction R2 along the guide groove 36*g* from a contacting point C2 with the guide groove 36*g*.

That is, as illustrated in FIG. 7, the standby position P0 of each of the second mounting hole 36*e* of the rotary winding portion 36*b* and the projection 44*b* of the operation wire 44 is also set at a position where the operation wire 44 is wound in advance by the predetermined length $\alpha 0$ in the second direction R2 which is opposite to the first direction R1 along the guide groove 36*g* from the contacting point C2 with the guide groove 36*g*.

Further, as illustrated in FIG. 7, the predetermined length $\alpha 0$ by which the operation wire 44 is wound in advance is approximately a quarter of an entire circumference (circular arc) length of the guide groove 36*g*.

Next, as illustrated in FIGS. 4 and 6, on an inner circumferential side of the rotary winding portion 36*b*, a guide groove 36*h* for limiting rotation is formed in a semicircular arc shape around the central axis A1.

Further, as illustrated in FIGS. 5 and 6, a protrusion 34*a* for limiting rotation that protrudes into the guide groove 36*h* for limiting rotation is provided on a top surface inside the upper casing 34.

The guide grooves 36*h* for limiting rotation and the protrusion 34*a* for limiting rotation function as a rotating angle limiting device that limits a rotation angle of the pulley 36 when the pulley 36 rotates around the rotation central axis A1.

That is, when the pulley 36 is rotationally operated in the first direction R1 or the second direction R2 in accordance with the flushing mode, the protrusion 34*a* for limiting rotation abuts on one of end portions in a circumferential direction of the guide groove 36*h* for limiting rotation, and thereby an angle range in which the pulley 36 is rotatable is limited.

Here, as illustrated in FIG. 6, the standby position P0 of the protrusion 34*a* for limiting rotation in the standby state S0 before the electric operation of the electric operation unit 26 is started is located in a right side region from the rotation central axis A1 of the pulley 36 and on the axis X in plan view.

Further, as illustrated in FIG. 6, in the standby position P0 of the guide groove 36*h* for limiting rotation in the standby state S0 before the electric operation of the electric operation unit 26 is started, both end portions 36*i* and 36*j* in a circumferential direction of the guide groove 36*h* in plan view are respectively located in respective front side region and rear side region from the rotation central axis A1 of the pulley 36, and are located on an axis Y.

That is, as illustrated in FIG. 6, both the end portions 36*i* and 36*j* of the guide groove 36*h* in the standby position P0 in plan view are located symmetrically in the circumferential direction of the guide groove 36*h* with the protrusion 34*a* as a center.

Next, as illustrated in FIG. 8, in the discharge valve device 14 provided in the water storage tank 8 of the flush water tank device 4, the flush water tank device 4 is hidden at a back side of the wall W1, and a depth space in the water storage tank 8 is also limited to be small. Accordingly, an entire shape of the discharge valve device 14 disposed in the water storage tank 8 is a cylindrical shape which is substantially elongated and slim.

Further, the discharge valve device 14 includes a discharge port-forming member 52, the discharge valve body 24, a full-flushing control casing 54, a float 56, a partial-flushing control casing 58, a water weight 60, a cam 62, a control casing lid 64, an overflow pipe 66, the operation lever 48 for full-flushing mode, a hook member 68 and the operation lever 50 for partial-flushing mode.

First, as illustrated in FIG. 8, the discharge port-forming member 52 is connected to the bottom portion of the water storage tank 8, forms the discharge port 22 in a bottom surface in the water storage tank 8, and forms a valve seat 52*a* along an upper edge of the discharge port 22.

As illustrated in FIG. 8, the discharge valve body 24 is mounted to a vicinity of a lower end of the overflow pipe 66 so as to abut on the valve seat 52*a* to close the discharge port 22 when the overflow pipe 66 is located in a lowest position.

Further, as illustrated in FIG. 8, the overflow pipe 66 penetrates through the control casings 54 and 58 and the control lid 64 in a vertical direction to be slidable in the vertical direction. The operation lever 48 for full-flushing mode is linked to an outer surface of an upper opening forming portion 66*a* of the overflow pipe 66.

At a time of valve opening operation of the full-flushing mode, the operation lever 48 is pulled up by the operation wire 40, whereby the overflow pipe 66 and the discharge valve body 24 rise and the discharge port 22 is opened.

Further, as illustrated in FIG. 8, the hook member 68 is provided inside the control lid 64 and at a lower side of the upper opening forming portion 66*a* of the overflow pipe 66. The operation lever 50 for partial-flushing mode is linked to the hook member 68.

At a time of a valve opening operation of a partial-flushing mode, the operation lever 50 is pulled up by the operation wire 44, whereby the overflow pipe 66 and the discharge valve body 24 rise with the hook member 68, and the discharge port 22 is opened.

That is, a whole of the overflow pipe 66 and the discharge valve body 24 substantially functions as a discharge valve.

Further, when the water level in the water storage tank 8 exceeds an upper end position of the overflow pipe 66, the excessive flush water is discharged from the inside of the overflow pipe 66 into the discharge port 22 which always communicates with the overflow pipe 66.

Next, as illustrated in FIG. 8, the float 56 is provided in the full-flushing control casing 54 provided above the discharge port-forming member 52. In a side surface of the full-flushing control casing 54, an opening 54*a* capable of adjusting an opening area is formed, and an inside of the full-flushing control casing 54 and an inside of the water storage tank 8 communicate with each other by the opening 54*a*.

As illustrated in FIG. 8, the float 56 is movable up and down with the overflow pipe 66 in accordance with a water level in the full-flushing control casing 54.

The float 56 is formed from a material such as expanded polystyrene (EPS) easily affected by a buoyant, so that when a buoyant acts on the float 56 by flush water in the full-flushing control casing 54, the float 56 itself easily rises.

Next, as illustrated in FIG. 8, the tub-shaped water weight 60 is provided in the partial-flushing control casing 58 provided above the full-flushing control casing 54. An opening 58*a* capable of adjusting an opening area is formed in a side surface of the partial-flushing control casing 58, and an inside of the partial-flushing control casing 58 and the inside of the water storage tank 8 communicate with each other by the opening 58*a*.

As illustrated in FIG. 8, in the water weight 60, flush water is always fully stored. The water weight 60 is movable up and down in accordance with a water level in the partial-flushing control casing 58.

A rib 66*b* on an outer surface of the overflow pipe 66 is capable of abutting on an inner peripheral side upper edge portion 60*a* of the water weight 60 surrounding the outer surface of the overflow pipe 66 from a lower side when the overflow pipe 66 rises. In a state where the rib 66*b* of the overflow pipe 66 abuts on the inner peripheral side upper edge portion 60*a* of the water weight 60, the water weight 60 is also capable of rising integrally with rise of the overflow pipe 66.

Next, as illustrated in FIG. 8, the cam 62 for controlling the water weight is rotatably linked to the water weight 60.

The cam 62 for controlling the water weight does not abut on the overflow pipe 66 normally in the full-flushing mode.

Incidentally, as illustrated in FIG. 8, the cam 62 in the standby state (the initial position before valve opening) is in a state where an upper end of the cam 62 is rotated to a distal side with respect to the overflow pipe 66 by a lower end of the cam 62 abutting on a protrusion 58*b* in the partial-flushing control casing 58.

When the water weight 60 rises with rise of the overflow pipe 66, with a valve opening operation in the full-flushing mode thereafter, the upper end of the cam 62 abuts on a guide portion 64*a* of the control casing lid 64, and rotates to a rib 68*a* side (a proximal side) of the hook member 68.

The upper end of the cam 62 abuts on and is hooked on the rib 68*a* of the hook member 68, and thereby the water weight 60 is suspended without abutting on the outer surface of the overflow pipe 66.

Thereby, a weight of the water weight 60 does not act onto the overflow pipe 66 after valve opening, so that a valve closing operation of the overflow pipe 66 can be delayed.

In the partial-flushing mode, the cam 62 for controlling the water weight abuts on the overflow pipe 66 which is lowering, and thereby a load of the water weight 60 acts on the overflow pipe 66 at a time of valve closing. Thereby, the valve closing operation of the overflow pipe 66 at a time of the partial-flushing mode can be advanced more than the valve closing operation of the overflow pipe 66 at the time of the full-flushing mode.

Figure 9:
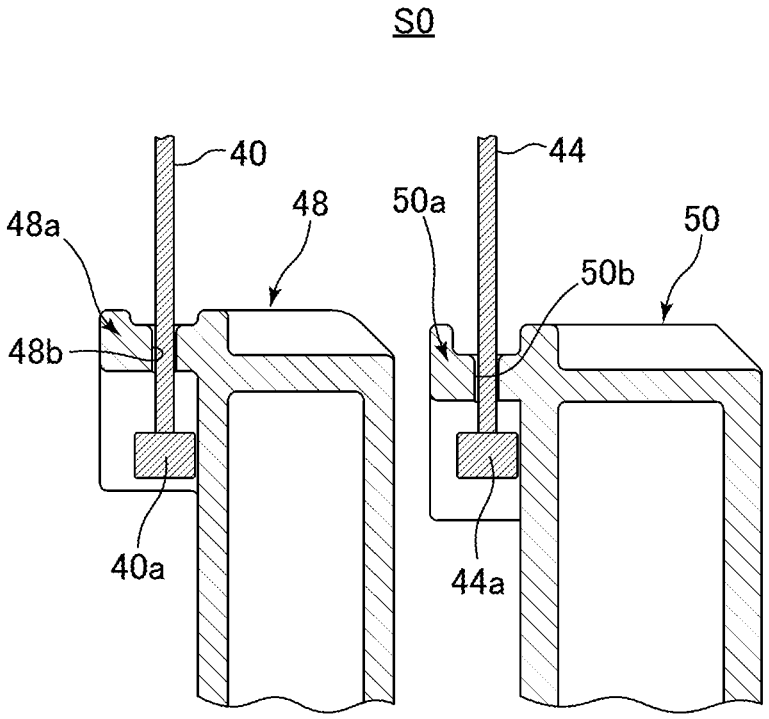
FIG. 9 is an enlarged sectional view in which linking portions of respective levers and respective operation wires in the discharge valve device that is operated by the discharge valve operating device according to one embodiment of the present invention illustrated in FIG. 8 are enlarged.

Next, FIG. 9 is an enlarged sectional view in which the linking portions of the respective levers and the respective operation wires in the discharge valve device that is operated by the discharge valve operating device according to one embodiment of the present invention illustrated in FIG. 8 are enlarged.

As illustrated in FIG. 9, through-holes 48*b* and 50*b* that penetrate in the vertical direction are respectively formed in respective linking portions 48*a* and 50*a* of the operation lever 48 for full-flushing mode and the operation lever 50 for partial-flushing mode.

Diameters of the respective through-holes 48*b* and 50*b* are set to be larger than diameters of the respective operation wires 40 and 44, and to be smaller than diameters of the respective projections 40*a* and 44*a*.

Thereby, the respective operation wires 40 and 44 are slidable in the vertical direction with respect to the respective through-holes 48*b* and 50*b*, and the respective projections 40*a* and 44*a* do not remove upward in a state engaged with the respective linking portions 48*a* and 50*a* from the lower side, when the respective operation wires 40 and 44 rise.

Next, with reference to FIGS. 6 to 19, an operation (an action) of the discharge valve operating device according to one embodiment of the present invention will be described with an operation of the discharge valve device.

First, with reference to FIGS. 6 to 14, an operation at a time of performing a valve opening operation of the full-flushing mode by using the discharge valve operating device 1 according to the present embodiment will be described.

Figure 10:
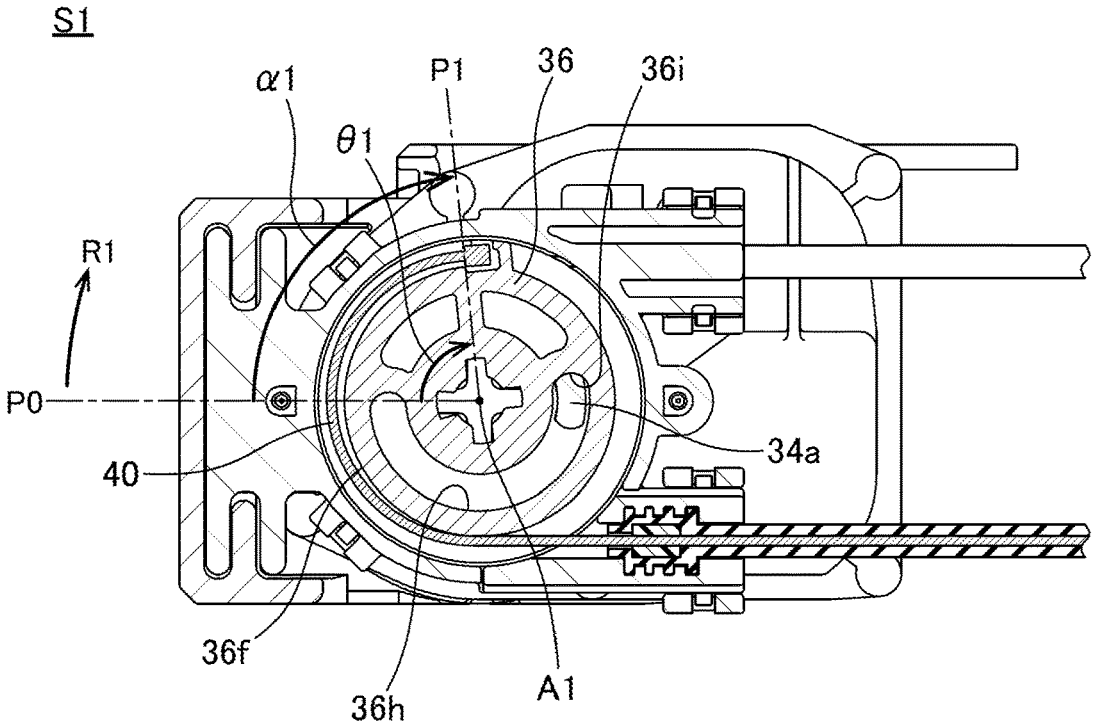
FIG. 10 is a sectional view similar to FIG. 6, illustrating the electric operation unit of the discharge valve operating device according to one embodiment of the present invention, and illustrates a pulley and an operation wire for full flushing in a state where a full-flushing mode is started.

FIG. 10 is a sectional view similar to FIG. 6 illustrating the electric operation unit of the discharge valve operating device according to one embodiment of the present invention, and illustrates the pulley and the operation wire for full flushing in the state where the full-flushing mode is started.

Figure 11:
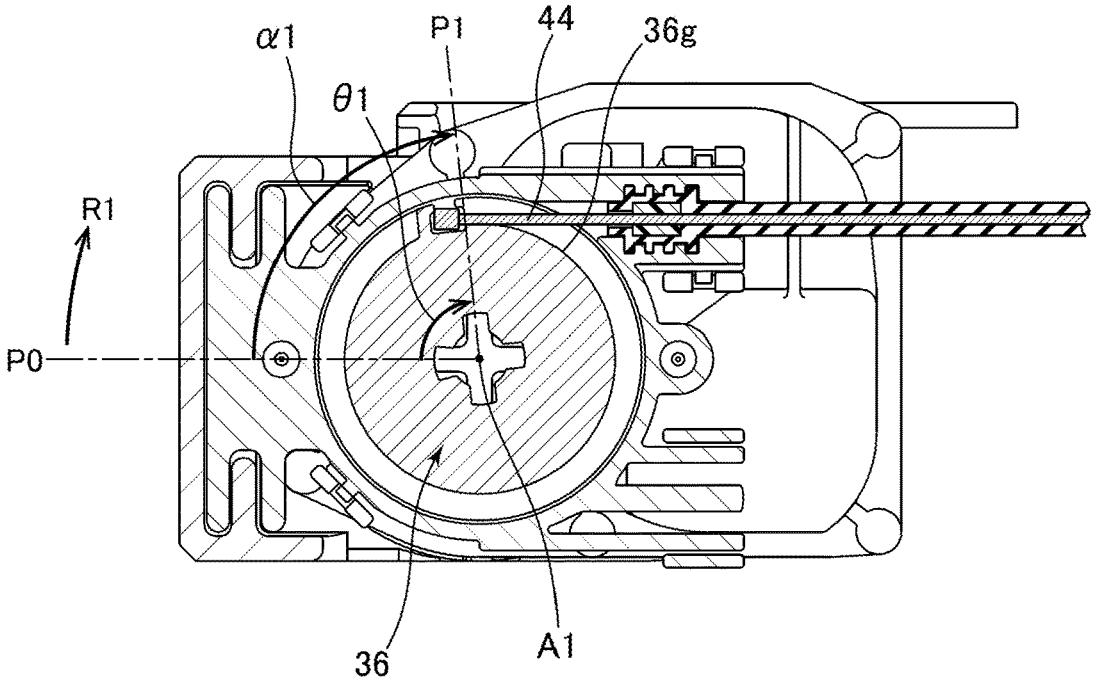
FIG. 11 is a sectional view similar to FIG. 7 illustrating the electric operation unit of the discharge valve operating device according to one embodiment of the present invention, and illustrates a pulley and an operation wire for partial flushing in a state where the full-flushing mode is started.

Further, FIG. 11 is a sectional view similar to FIG. 7 illustrating the electric operation unit of the discharge valve operating device according to one embodiment of the present invention, and illustrates the pulley and the operation wire for partial flushing in the state where the full-flushing mode is started.

Figure 12:
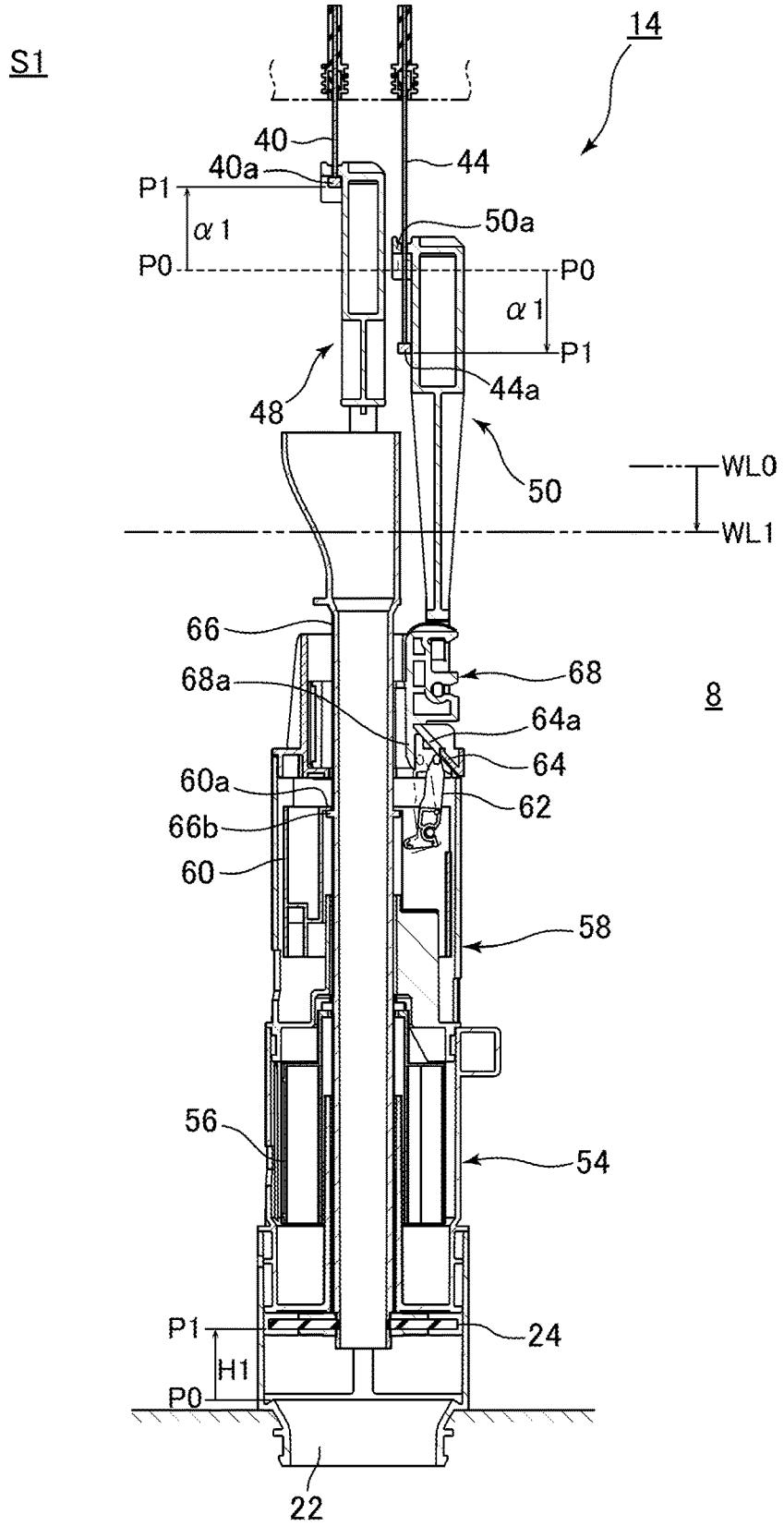
FIG. 12 is a schematic sectional front view of the discharge valve device that is operated by the discharge valve operating device according to one embodiment of the present invention, and illustrates an opened valve state at a time of the full-flushing mode being started.

Further, FIG. 12 is a schematic sectional front view of the discharge valve device which is operated by the discharge valve operating device according to one embodiment of the present invention, and illustrates an opened valve state at the time of starting the full-flushing mode.

Figure 13:
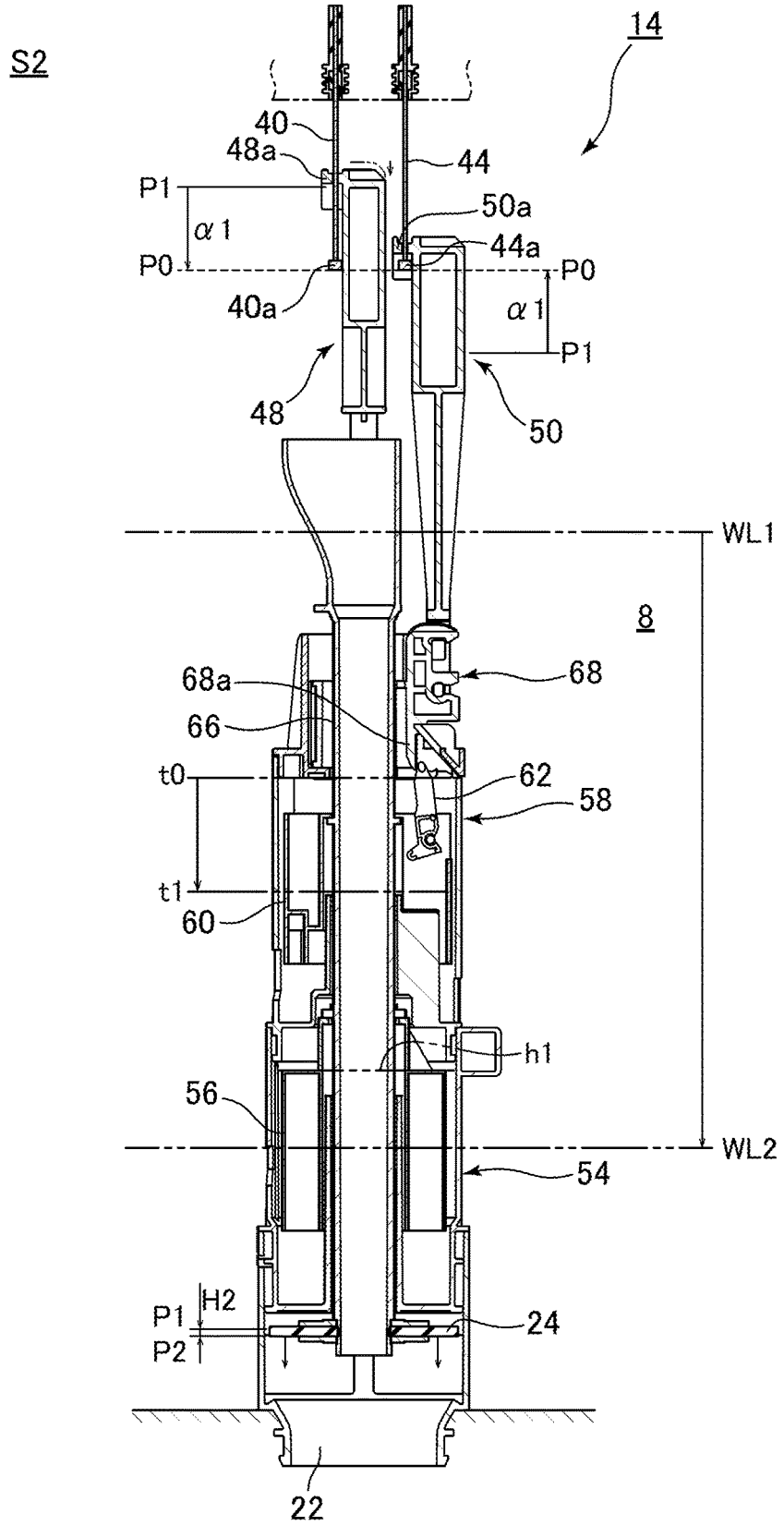
FIG. 13 is a schematic sectional front view of the discharge valve device that is operated by the discharge valve operating device according to one embodiment of the present invention, and illustrates a closing valve half way state of the full-flushing mode.

Further, FIG. 13 is a schematic sectional front view of the discharge valve device which is operated by the discharge valve operating device according to one embodiment of the present invention, and illustrates a closing valve half way state in the full-flushing mode.

Figure 14:
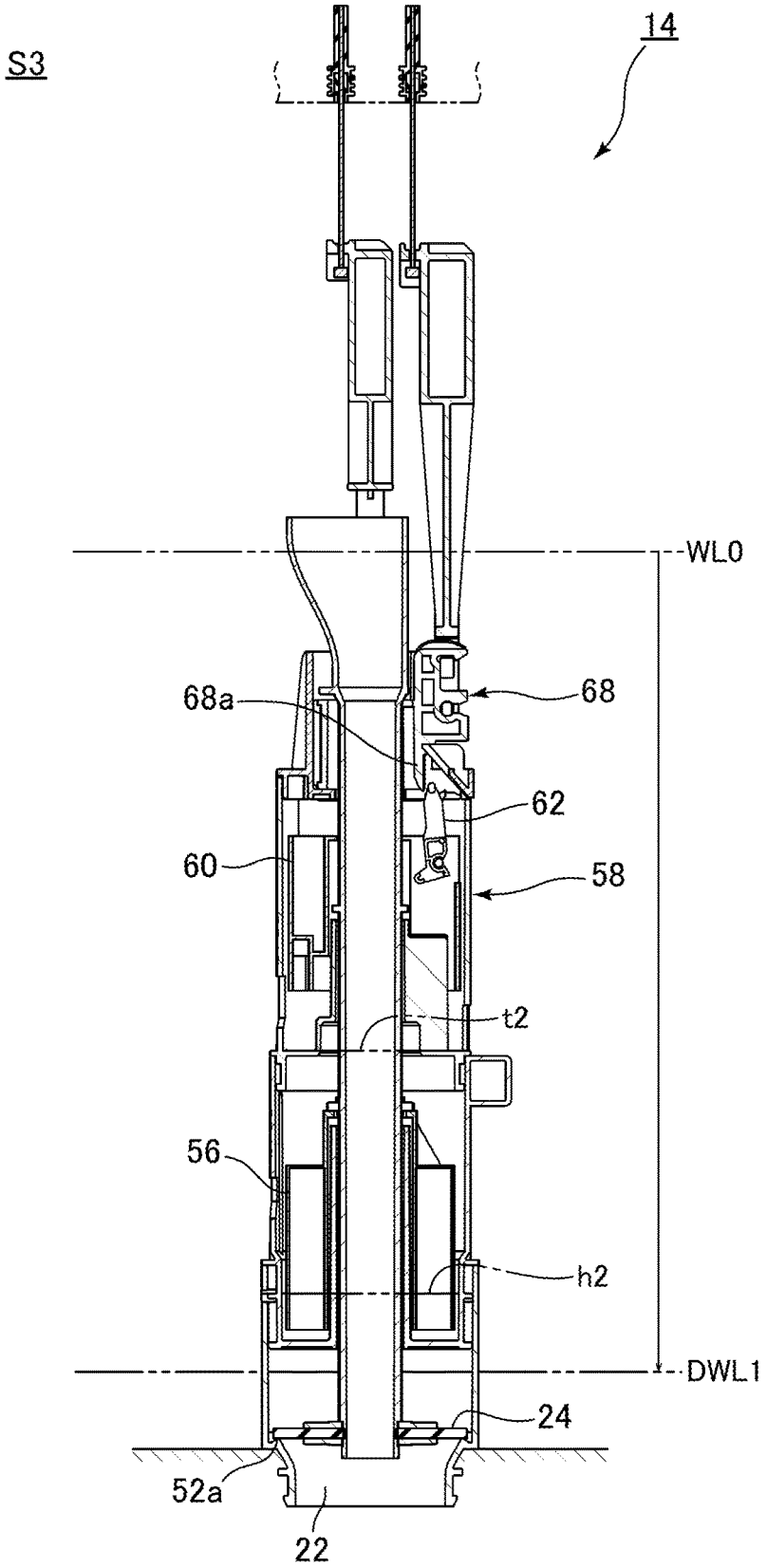
FIG. 14 is a schematic sectional front view of the discharge valve device that is operated by the discharge valve operating device according to one embodiment of the present invention, and illustrates a closed valve state in which the full-flushing mode is completed.

Further, FIG. 14 is a schematic sectional front view of the discharge valve device which is operated by the discharge valve operating device according to one embodiment of the present invention, and illustrates a closed valve state where the full-flushing mode is completed.

First, as illustrated in FIGS. 6 to 9, from the standby state S0 where the discharge valve body 24 of the discharge valve device 14 closes the discharge port 22, a valve opening operation is performed in the full-flushing mode, with respect to the discharge valve body 24 by an electric operation of the electric operation unit 26 of the discharge valve operating device 1 of the present embodiment.

At this time, for example, when a user instructs a toilet flushing operation in the full-flushing mode by pressing a predetermined operation button (not illustrated) of a remote controller (not illustrated) or the like, or the human sensor (not illustrated) senses the user, a signal thereof is transmitted to the control device (not illustrated).

Subsequently, the electric rotating shaft 26*a* of the electric operation unit 26 illustrated in FIGS. 6 and 7 is actuated, and the pulley 36 rotates in the first direction R1 around the rotation central axis A1 with the electric rotating shaft 26*a*, and starts the valve opening operation in the full-flushing mode.

Next, as illustrated in FIGS. 10 and 11, the pulley 36 rotates by a rotation angle θ1 (for example, θ1=83.5[°]) in the first direction R1 around the rotation central axis A1 from the standby position P0, and is in a start state S1 of the full-flushing mode. In the state S1, the end portion 36*i* at one side of the guide groove 36*h* for limiting rotation of the rotary winding portion 36*b* abuts on the protrusion 34*a* for limiting rotation, and rotation of the pulley 36 is limited (refer to FIG. 10).

At this time, as illustrated in FIG. 10, the operation wire 40 for full-flushing mode moves by a first length α1 [mm] while being wound on the guide groove 36*f* of the rotary winding portion 36*b* of the pulley 36.

Thereby, as illustrated in FIG. 12, the operation wire 40 for full-flushing mode is pulled up by the first length α1 [mm] from the standby position P0 to a position P1.

At the same time, the projection 40*a* of the operation wire 40 is pulled up in a state where the projection 40*a* is engaged with the linking portion 48*a* of the operation lever 48 for full-flushing mode.

Thereby, as illustrated in FIG. 12, the operation lever 48 for full-flushing mode is pulled up by a predetermined distance H1 [mm] (H1=α1) which is equal to the first length α1 [mm].

Further, as illustrated in FIG. 12, by pulling up the operation lever 48 for full-flushing mode, the overflow pipe 66 and the discharge valve body 24 of the discharge valve device 14 are also pulled up by the predetermined distance H1 [mm] (H1=α1) from the closed valve position P0 to a highest position P1.

At this time, as illustrated in FIG. 12, the float 56 in the full-flushing control casing 54 rises to a highest position by a buoyant force, and supports rise of the overflow pipe 66 and the discharge valve body 24.

Further, in the discharge valve device 14 in the state S1 illustrated in FIG. 12, with the valve opening operation of the full-flushing mode, the rib 66*b* of the overflow pipe 66 comes into a state abutting on the inner peripheral side upper edge portion 60*a* of the water weight 60 from the lower side, with rise of the overflow pipe 66. Thereby, the water weight 60 also rises integrally with the overflow pipe 66.

Further, as illustrated in FIG. 12, the upper end of the cam 62 abuts on an inclined surface of the guide portion 64*a* of the control casing lid 64, and rotates by being guided by the rib 68*a* side (the proximal side) of the hook member 68. Subsequently, the upper end of the cam 62 abuts on and is hooked on the rib 68*a* of the hook member 68. Thereby, the water weight 60 is suspended without abutting on the outer surface of the overflow pipe 66, and thereafter, the weight of the water weight 60 does not act on the overflow pipe 66 until the valve is closed.

Consequently, the overflow pipe 66 is smoothly pulled up to the highest position without being influenced by the water weight 60.

Thereby, the discharge valve body 24 smoothly opens, and the flush water in the water storage tank 8 is started to be discharged to the conduit (not illustrated) of the toilet body 4 from the discharge port 22.

As illustrated in FIG. 11, the operation wire 44 for partial-flushing mode moves by the first length α1 [mm] while being unwound from the guide groove 36*g* of the rotary winding portion 36*b* by rotation in the first direction R1 of the pulley 36.

Thereby, as illustrated in FIG. 12, the operation wire 44 for partial-flushing mode lowers by the first length α1 [mm] to the position P1 from the standby position P0. At the same time, the projection 44*a* of the operation wire 44 lowers without engaging with the linking portion 50*a* of the operation lever 50 for partial-flushing mode. Consequently, in the start state S1 of the full-flushing mode, the operation lever 50 for partial-flushing mode is in a stationary state without being pulled up.

Incidentally, the water level of the flush water in the water storage tank 8 in the state S1 illustrated in FIG. 12 lowers to a water level WL1 from a full water level WL0 in the standby state S0 illustrated in FIG. 8.

Next, after the state S1 illustrated in FIGS. 10 to 12, a DC motor (not illustrated) of the electric operation unit 26 stops for a predetermined time period, and the electric rotating shaft 26*a* stops for a predetermined time period. Thereby, the discharge valve body 24 is brought into a state where the discharge valve body 24 is opened for the predetermined time period at the highest position P1.

Subsequently, after the discharge valve body 24 is opened for the predetermined time period, the DC motor (not illustrated) of the electric operation unit 26 is actuated again.

Thereby, the electric rotating shaft 26*a* and the pulley 36 rotate (reverse) by the rotation angle θ1 in the second direction R2 around the rotation central axis A1 and thereafter stop again, and are brought into a state S2 similar to the standby state S0 illustrated in FIGS. 6 and 7.

That is, the operation wire 40 for full-flushing mode from the state S1 illustrated in FIG. 10 to the state S2 illustrated in FIG. 6 moves by the first length α1 [mm] while being unwound from the guide groove 36*f* of the rotary winding portion 36*b* of the pulley 36 from the position P1 illustrated in FIG. 10 to the position P0 illustrated in FIG. 6.

Thereby, as illustrated in FIG. 13, the operation wire 40 for full-flushing mode is brought into the state S2 where the operation wire 40 lowers by the first length α1 [mm] to the position P0 from the position P1.

At the same time, the projection 40*a* of the operation wire 40 lowers without engaging with the linking portion 48*a* of the operation lever 48 for full-flushing mode.

The operation wire 44 for partial-flushing mode from the state S1 illustrated in FIG. 11 to the state S2 illustrated in FIG. 7 moves by the first length α1 [mm] while being wound on the guide groove 36*g* of the rotary winding portion 36*b* of the pulley 36 to the position P0 illustrated in FIG. 7 from the position P1 illustrated in FIG. 11.

Thereby, as illustrated in FIG. 13, the operation wire 44 for partial-flushing mode is brought into the state S2 where the operation wire 44 is pulled up by the first length α1 [mm] to the position P0 from the position P1.

At the same time, the projection 44*a* of the operation wire 44 rises to a vicinity of the linking portion 50*a* of the operation lever 50 for partial-flushing mode.

At this time, the water level in the water storage tank 8 in the state S2 illustrated in FIG. 13 lowers to a water level WL2 from the water level WL1 illustrated in FIG. 12.

Further, a water level in the full-flushing control casing 54 in the state S2 illustrated in FIG. 13 also lowers to a water level h1 from the full water level illustrated in FIG. 12. Thereby the float 56 also lowers, so that with the float 56, the overflow pipe 66 and the discharge valve body 24, and the operation lever 48 for full-flushing mode are in a position P2 which is lowered by a distance H2 (refer to FIG. 13) from the position P1.

Further, a water level in the partial-flushing control casing 58 in the state S2 illustrated in FIG. 13 is also lowered to a water level t1 from a full water level t0.

However, in the state S2 illustrated in FIG. 13, the upper end of the cam 62 is in a state where the upper end abuts on and is hooked on the rib 68*a* of the hook member 68. Thereby, the water weight 60 and the cam 62 do not involve in the operations of the overflow pipe 66 and the discharge valve body 24, and the water weight 60 is in a state floating at a water level in the partial-flushing control casing 58.

Next, when the water level in the water storage tank 8 further lowers after the state S2 illustrated in FIG. 13, the buoyant force of the float 56 is eliminated, and the overflow pipe 66 and the discharge valve body 24 and the operation lever 48 for full-flushing mode further lower.

Finally, as illustrated in FIG. 14, a state where the discharge valve body 24 abuts on the valve seat 52*a* to close the discharge port 22, that is, a state S3 in which the full-flushing mode is completed is brought about.

Further, as illustrated in FIG. 14, in the state S3, the float 56 is brought into a state where the float 56 floats by a water level h2 of the flush water in the full-flushing control casing 54.

Further, as illustrated in FIG. 14, in the state S3, a water level t2 of the flush water in the partial-flushing control casing 58 is a lowest water level. However, the state where the upper end of the cam 62 abuts on and is hooked on the rib 68*a* of the hook member 68 is kept, so that the water weight 60 is in a state floating in the partial-flushing control casing 58.

As illustrated in FIG. 14, the water level in the water storage tank 8 is a lowest water level DWL1 of the full-flushing mode.

As a result of the above, in the full-flushing mode, as illustrated in FIG. 14, a flush water amount which is reduced to the lowest water level DWL1 from the full water level WL0 in the water storage tank 8 is supplied into the conduit (not illustrated) to the toilet body 10 from the discharge port 22, and toilet flushing by the full-flushing mode is performed.

Next, an operation at a time of performing the valve opening operation in the partial-flushing mode by using the discharge valve operating device 1 according to the present embodiment will be described with reference to FIGS. 6 to 9 and FIGS. 15 to 19.

Figure 15:
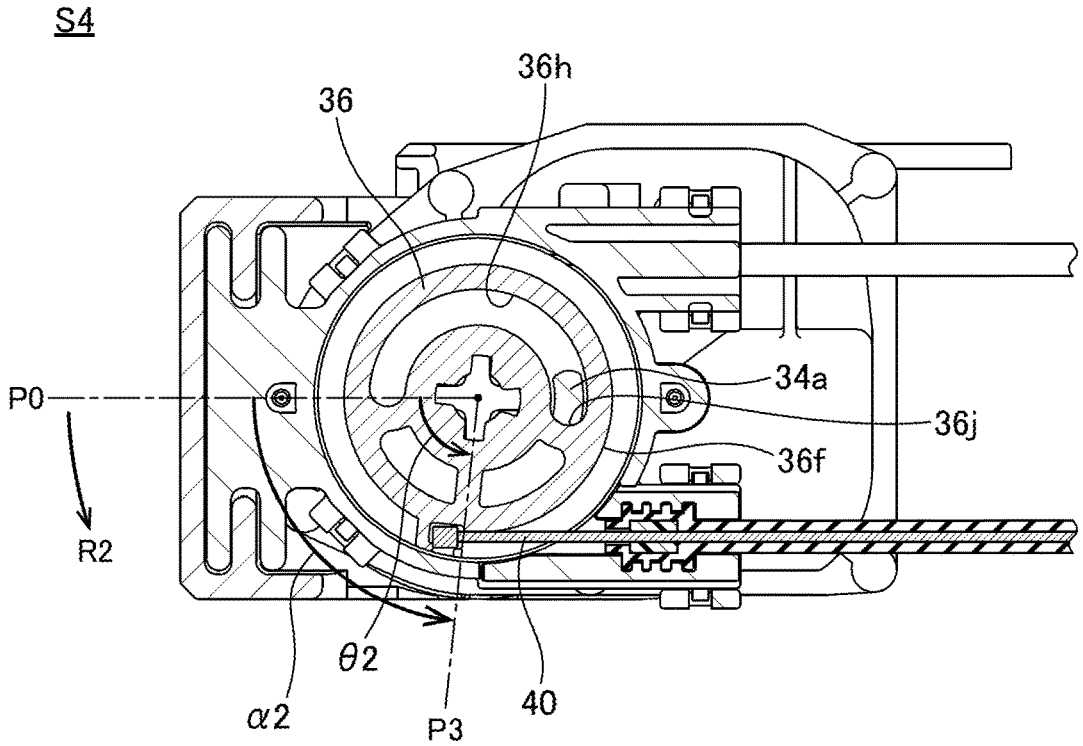
FIG. 15 is a sectional view similar to FIG. 6 illustrating the electric operation unit of the discharge valve operating device according to one embodiment of the present invention, and illustrates the pulley and the operation wire for full flushing in a state where a partial-flushing mode is started.

FIG. 15 is a sectional view similar to FIG. 6 illustrating the electric operation unit of the discharge valve operating device according to one embodiment of the present invention, and illustrates the pulley and the operation wire for full flushing in a state where the partial-flushing mode is started.

Figure 16:
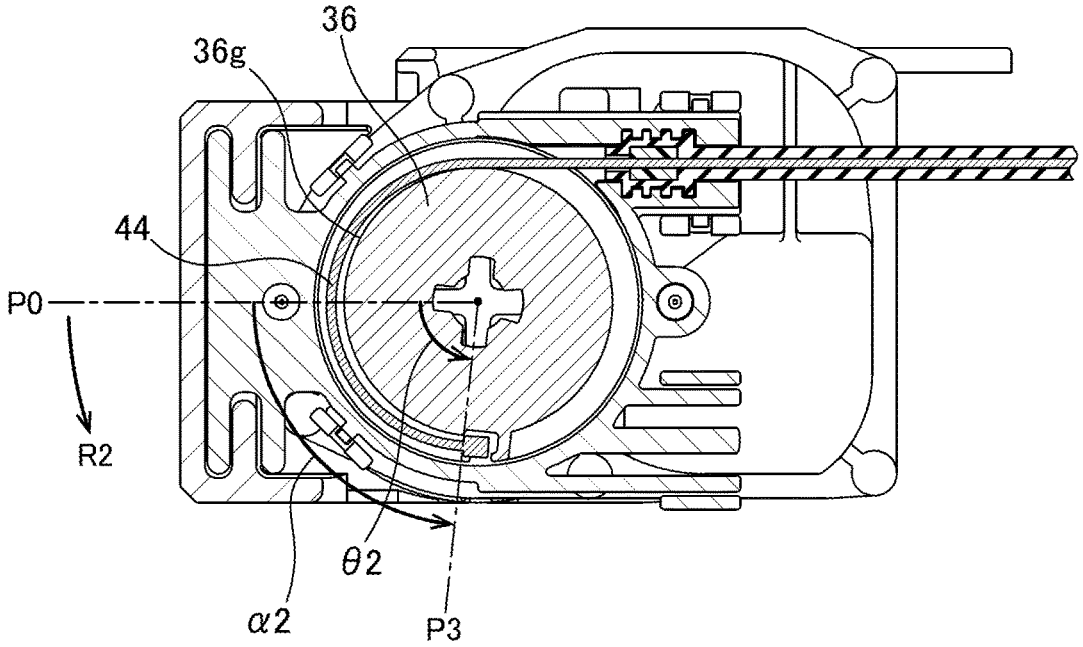
FIG. 16 is a sectional view similar to FIG. 6 illustrating the electric operation unit of the discharge valve operating device according to one embodiment of the present invention, and illustrates the pulley and the operation wire for partial flushing in a state where the partial-flushing mode is started.

Further, FIG. 16 is a sectional view similar to FIG. 6 illustrating the electric operation unit of the discharge valve operating device according to one embodiment of the present invention, and illustrates the pulley and the operation wire for partial flushing in the state where the partial-flushing mode is started.

Figure 17:
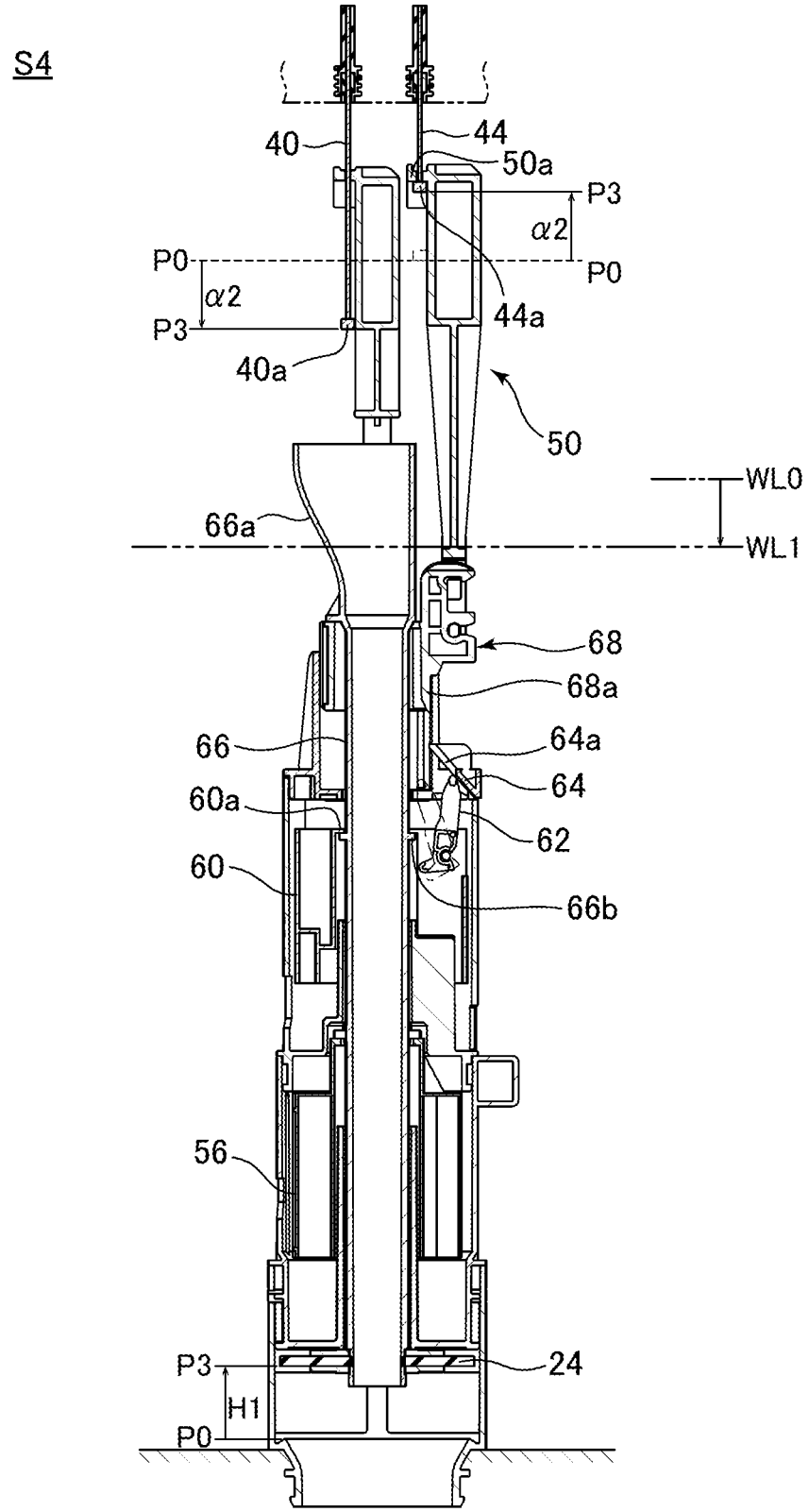
FIG. 17 is a schematic sectional front view of the discharge valve device that is operated by the discharge valve operating device according to one embodiment of the present invention, and illustrates an opened valve state at a time of the partial-flushing mode is started.

Further, FIG. 17 is a schematic sectional front view of the discharge valve device which is operated by the discharge valve operating device according to one embodiment of the present invention, and illustrates an opened valve state where the partial-flushing mode is started.

Figure 18:
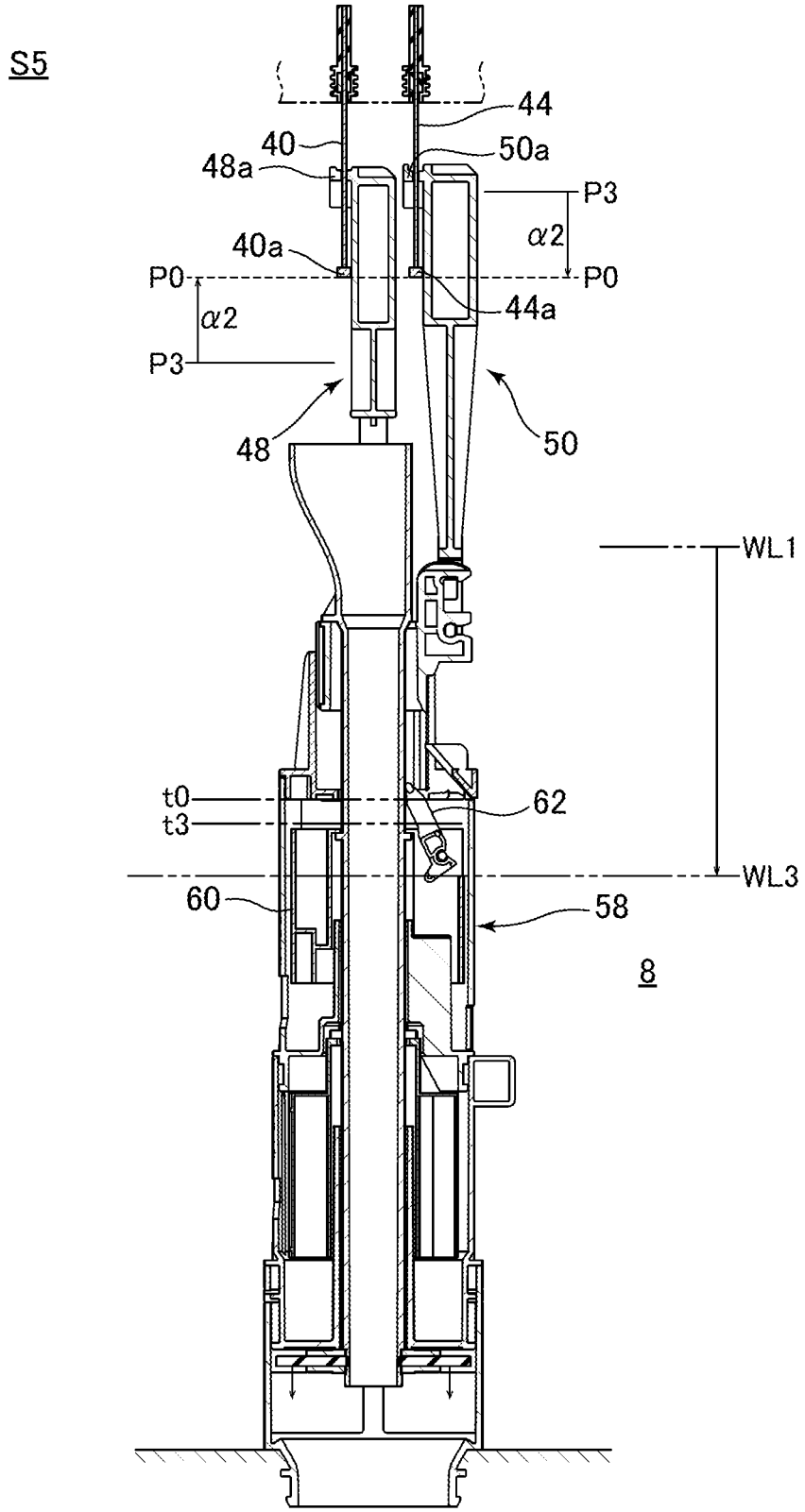
FIG. 18 is a schematic sectional front view of the discharge valve device that is operated by the discharge valve operating device according to one embodiment of the present invention, and illustrates a closing valve half way state of the partial-flushing mode.

Further, FIG. 18 is a schematic sectional front view of the discharge valve device which is operated by the discharge valve operating device according to one embodiment of the present invention, and illustrates a closing valve half way state in the partial-flushing mode.

Figure 19:
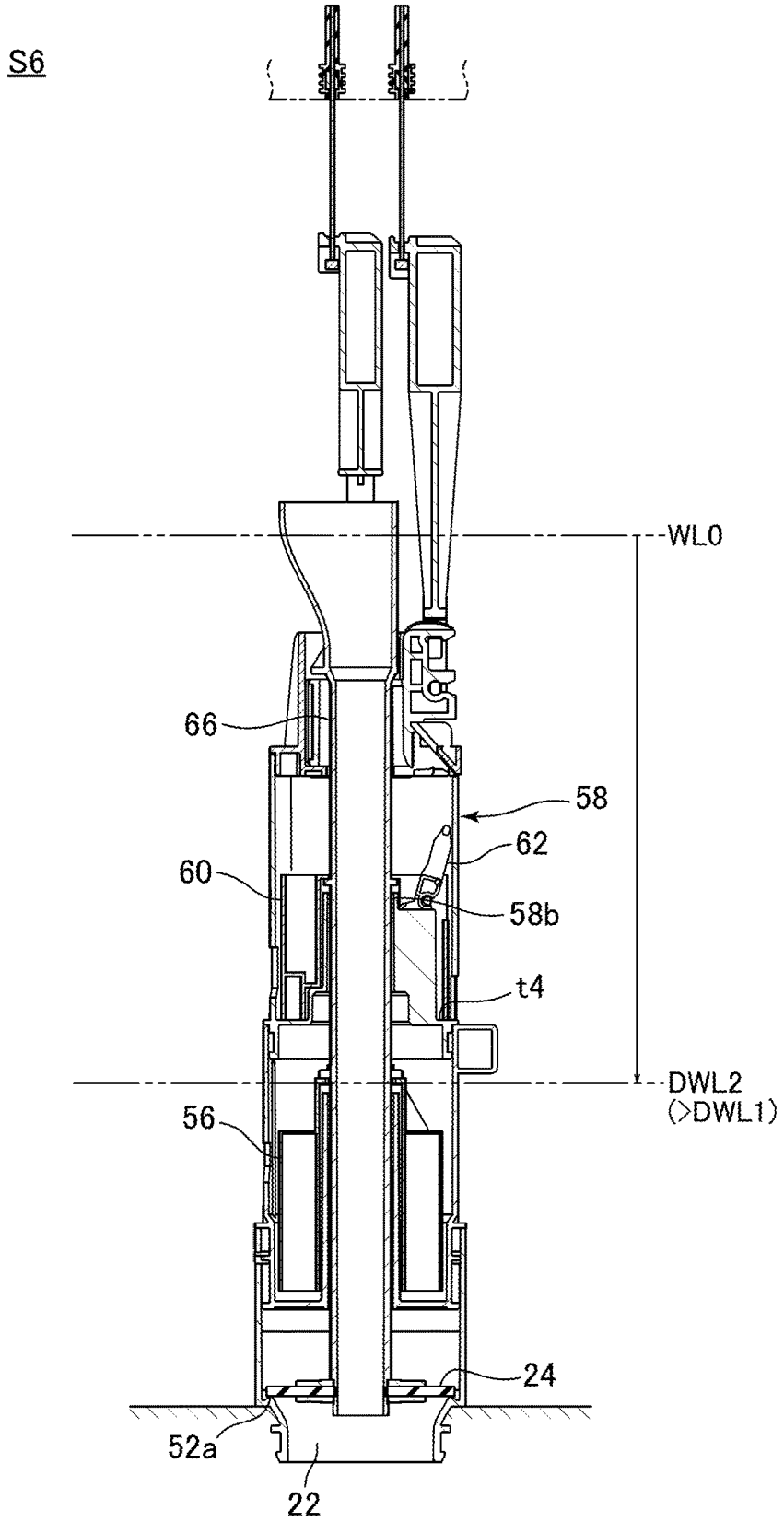
FIG. 19 is a schematic sectional front view of the discharge valve device that is operated by the discharge valve operating device according to one embodiment of the present invention, and illustrates a closed valve state where the partial-flushing mode is completed.

Furthermore, FIG. 19 is a schematic sectional front view of the discharge valve device which is operated by the discharge valve operating device according to one embodiment of the present invention, and illustrates a closed valve state in which the partial-flushing mode is completed.

First, as illustrated in FIGS. 6 to 9, from the standby state S0 where the discharge valve body 24 of the discharge valve device 14 closes the discharge port 22, a valve opening operation is performed in the partial-flushing mode, with respect to the discharge valve body 24 by an electric operation of the electric operation unit 26 of the discharge valve operating device 1 of the present embodiment.

On this occasion, for example, when a user instructs a toilet flush operation in the partial-flushing mode by pressing a predetermined operation button (not illustrated) of the remote controller (not illustrated) or the like, or the human sensor (not illustrated) senses the user, a signal thereof is transmitted to the control device (not illustrated).

Subsequently, the electric rotating shaft 26*a* of the electric operation unit 26 illustrated in FIGS. 6 and 7 is actuated, and the pulley 36 rotates in the second direction R2 opposite to the first direction R1 around the rotation central axis A1 with the electric rotating shaft 26*a*, and starts the valve opening operation in the partial-flushing mode.

Next, as illustrated in FIGS. 15 and 16, the pulley 36 rotates by a rotation angle θ2 (for example, θ2=83.5[°]) in the second direction R2 around the rotation central axis A1 from the standby position P0, and is in a start state S4 of the partial-flushing mode. In the state S4, the end portion 36*j* at the other side of the guide groove 36*h* for limiting rotation of the rotary winding portion 36*b* abuts on the protrusion 34*a* for limiting rotation, and rotation of the pulley 36 is limited (refer to FIG. 15).

At this time, as illustrated in FIG. 16, the operation wire 44 for partial-flushing mode moves by a second length α2 [mm] (α2=α1) that is equal to the first length α1 at the time of the full-flushing mode while being wound on the guide groove 36*g* of the rotary winding portion 36*b* of the pulley 36.

Thereby, as illustrated in FIG. 17, the operation wire 44 for partial-flushing mode is pulled up by the second length α2 [mm] from the standby position P0 to a position P3.

At the same time, the projection 44*a* of the operation wire 44 is pulled up in a state where the projection 44*a* is engaged with the linking portion 50*a* of the operation lever 50 for partial-flushing mode.

Consequently, as illustrated in FIG. 17, the operation lever 50 for partial-flushing mode is pulled up by the predetermined distance H1 [mm] (H1=α2) which is equal to the second length α2 [mm].

Further, as illustrated in FIG. 17, by pulling up the operation lever 50 for partial-flushing mode, the hook member 68 which is linked to the operation lever 50 is pulled up. By rise of the hook member 68, the overflow pipe 66 is pulled up. Thereby, the discharge valve body 24 is also pulled up by the predetermined distance H1 [mm] (H1=α2) from the closed valve position P0 to the highest position P3.

Therefore, in the partial-flushing mode, the discharge valve body 24 also opens smoothly by a similar operation to the operation in the full-flushing mode, and the flush water in the water storage tank 8 is started to be discharged into the channel (not illustrated) of the toilet body 4 from the discharge port 22.

As illustrated in FIG. 15, the operation wire 40 for full-flushing mode moves by the second length α2 [mm] while being unwound from the guide groove 36*f* of the rotary winding portion 36*b* by rotation in the second direction R2 of the pulley 36.

Thereby, as illustrated in FIG. 17, the operation wire 40 for full-flushing mode lowers by the second length α2 [mm] to the position P3 from the standby position P0.

At the same time, the projection 40*a* of the operation wire 40 lowers without engaging with the linking portion 48*a* of the operation lever 48 for full-flushing mode.

Therefore, in the start state S4 in the partial-flushing mode, the operation lever 48 for full-flushing mode is not pulled up by the operation wire 40 itself for full-flushing mode.

However, as illustrated in FIG. 17, in the state S4, the operation lever 48 for full-flushing mode is linked to the overflow pipe 66, and therefore is in a state where the operation lever 48 rises by only the predetermined distance H1 [mm] from the valve closed position P0 to the highest position P3 with the overflow pipe 66 and the discharge valve body 24.

Further, in the discharge valve device 14 in the state S4 illustrated in FIG. 17, with the valve opening operation in the partial-flushing mode, similarly to the valve opening operation in the full-flushing mode, the rib 66*b* of the overflow pipe 66 is also brought into a state where the rib 66*b* abuts on the inner peripheral side upper edge portion 60*a* of the water weight 60 from the lower side, with rise of the overflow pipe 66. Thereby, the water weight 60 also rises integrally with the overflow pipe 66.

Here, the cam 62 of the water weight 60 in the partial-flushing control casing 58 of the discharge valve device 14 in the state S4 illustrated in FIG. 17 rotates while being guided to the overflow pipe 66 side by the upper end of the cam 62 abutting on the inclined surface of the guide portion 64*a* of the control casing lid 64.

However, in the partial-flushing mode in the state S4 illustrated in FIG. 17, the hook member 68 and the rib 68*a* are in the state where the hook member 68 and the rib 68*a* rise with the overflow pipe 60, unlike the full-flushing mode.

Therefore, the upper end of the cam 62 is not hooked on the rib 68*a* of the hook member 68, and is in a state where the upper end abuts on the outer surface of the overflow pipe 66.

In a state halfway through valve opening before reaching the state S4 illustrated in FIG. 17 from the standby state S0 illustrated in FIG. 8 in the partial-flushing mode, the upper end of the cam 62 does not abut on the outer surface of the overflow pipe 66, so that even when the water level in the water weight 60 is in a full state, the weight of the water weight 60 does not act on the overflow pipe 66.

Further, in the state S4 illustrated in FIG. 17, the water level of the flush water in the water storage tank 8 is lowered to the water level WL1 from the full water level WL0 in the standby state S0 illustrated in FIG. 8, as in the state S1 of the full-flushing mode.

Next, after the state S4 illustrated in FIGS. 15 to 17, the DC motor (not illustrated) of the electric operation unit 26 stops for a predetermined time period, and the electric rotating shaft 26*a* stops for the predetermined time period. Thereby, the discharge valve body 24 is in a state where the discharge valve body 24 opens for the predetermined time period at the highest position P3.

Subsequently, after the discharge valve body 24 opens for the predetermined time period, the DC motor (not illustrated) of the electric operation unit 26 is actuated again.

Thereby, the electric rotating shaft 26*a* and the pulley 36 rotate (reverse) by the rotation angle θ1 in the first direction R1 around the rotation central axis A1 and thereafter stop again, and are in a state S5 similar to the standby state S0 illustrated in FIGS. 6 and 7.

That is, the operation wire 44 for partial-flushing mode from the state S4 illustrated in FIG. 16 to the state S5 illustrated in FIG. 7 moves by the second length a2 [mm] while being unwound from the guide groove 36*g* of the rotary winding portion 36*b* of the pulley 36, from the position P3 illustrated in FIG. 16 to the position P0 illustrated in FIG. 7.

Thereby, as illustrated in FIG. 18, the operation wire 44 for partial-flushing mode lowers by the second length α2 [mm] from the position P3 to the position P0.

At the same time, the projection 44*a* of the operation wire 44 lowers without engaging with the linking portion 50*a* of the operation lever 50 for partial-flushing mode.

The operation wire 40 for full-flushing mode from the state S4 illustrated in FIG. 15 to the state S5 illustrated in FIG. 6 moves by the second length α2 [mm] while being wound on the guide groove 36*f* of the rotary winding portion 36*b* of the pulley 36 from the position P3 illustrated in FIG. 15 to the position P0 illustrated in FIG. 6.

Thereby, as illustrated in FIG. 18, the operation wire 40 for full-flushing mode is brought into the state S5 where the operation wire 40 is pulled up by the second length α2 [mm] from the position P3 to the position P0.

At this time, the projection 40*a* of the operation wire 40 does not engage with the linking portion 48*a* of the operation lever 48 for full-flushing mode, and is separated downward from the linking portion 48*a*.

Further, the water level in the water storage tank 8 in the state S5 illustrated in FIG. 18 is lowered from the water level WL1 illustrated in FIG. 17 to a water level WL3.

At this time, the water level in the partial-flushing control casing 58 in the state S5 illustrated in FIG. 18 is lowered to a water level t3 from the full water level to.

Further, in the state S5 illustrated in FIG. 18, the water weight 60 in the partial-flushing control casing 58 is in a floating state, but the state where the cam 62 abuts on the overflow pipe 66 is kept, so that the overflow pipe 66 lowers integrally with the water weight 60.

Next, when the water level in the water storage tank 8 further lowers after the state S5 illustrated in FIG. 18, the overflow pipe 66 also lowers. At this time, the weight of the water weight 60 acts on the overflow pipe 66, so that the overflow pipe 66 and the discharge valve body 24 lower at a higher speed than the speed in the full-flushing mode.

Finally, as illustrated in FIG. 19, a state where the discharge valve body 24 abuts on the valve seat 52*a* and closes the discharge port 22, that is, a state S6 where the partial-flushing mode is completed is brought about.

Further, as illustrated in FIG. 19, in the state S6, a water level t4 of the flush water in the partial-flushing control casing 58 is a lowest water level, and the water weight 60 is also at the lowest position. At this time, a lower end of the cam 62 abuts on the protrusion 58*b* in the partial-flushing control casing 58, and thereby rotates in a direction (the distal side) to be separated from the overflow pipe 66, and returns to an initial position in the standby state.

As illustrated in FIG. 19, the water level in the water storage tank 8 reaches the lowest water level DWL2 of the partial-flushing mode. The lowest water level DWL2 of the partial-flushing mode is a water level (DWL2>DWL1) higher than the lowest water level DWL1 of the full-flushing mode.

As a result of them, in the partial-flushing mode, as illustrated in FIG. 19, the flush water amount which is reduced to the lowest water level DWL2 from the full water level WL0 in the water storage tank 8 is discharged into the conduit (not illustrated) to the toilet body 10 from the discharge port 22, and toilet flushing by the partial-flushing mode with a smaller flush water amount than the flush water amount of the full-flushing mode is performed.

According to the discharge valve operating device 1 according to one embodiment of the aforementioned present invention, when the electric rotating shaft 26*a* of the electric operation unit 26 is simply operated rotationally by the same rotation operation amount θ1 in the different direction R1 or R2 in accordance with a desired flushing mode at a time of executing the full-flushing mode and the partial-flushing mode in which the flush water amounts differ from each other, the flushing mode can be easily switched to the different flushing mode by using the rotary winding portion 36*b* of the common pulley 36.

Further, the rotary winding portion 36*b* winds either one of the operation wire 40 for full-flushing mode or the operation wire 44 for partial-flushing mode by the same amount α1 or α2 in accordance of each of the flushing modes, whereby the valve opening operation of the constant pulling-up amount H1 of the discharge valve body 24 can be accurately performed irrespective of the flushing mode, and toilet flushing in the different flush modes can be easily executed.

Further, according to the discharge valve operating device 1 according to the present embodiment, when the electric rotating shaft 26*a* of the electric operation unit 26 is rotationally operated in accordance with the desired flushing mode when each of the full-flushing mode and the partial-flushing mode in which the flush water amounts differ respectively is executed, the rotary winding portion 36*b* of the pulley 36 can be rotated by the same rotation amount in the different direction R1 or R2 in accordance with the desired flushing mode with a rotation radius larger than the rotation radius of the electric rotating shaft 26*a*.

Accordingly, the rotary winding portion 36*b* of the pulley 36 can automatically wind up either one of the operation wire 40 for full-flushing mode or the operation wire 44 for partial-flushing mode in accordance with the flushing mode by the same amount α1 or α2. Thereby, irrespective of the flushing mode, the valve opening operation of the discharge valve body 24 of the constant pulling-up amount H1 can be performed automatically, and toilet flushing in the different flushing modes can be easily executed automatically.

Further, the rotary winding portion 36*b* of the pulley 36 is rotatable with the larger rotation radius than the rotation radius of the electric rotating shaft 26*a*, so that the rotary winding portion 36*b* of the pulley 36 can pull up either one of the operation wire 40 for full-flushing mode or the operation wire 44 for partial-flushing mode by a relatively large pulling-up amount with respect to the rotation angle θ1 of the electric rotating shaft 26*a*.

Consequently, the valve opening operation of the discharge valve body 24 can be efficiently performed.

Furthermore, according to the discharge valve operating device 1 according to the present embodiment, when the electric rotating shaft 26*a* of the electric operation unit 26 is rotationally operated in the first direction R1 from the standby state S0 before start of the electric operation of the electric operation unit 26 first, the rotary winding portion 36*b* of the pulley 36 rotates in the first direction R1 from the standby state S0, and the respective mounting holes 36*d* and 36*e* move by the first length α1 in the first direction R1 from the standby position P0.

Thereby, the operation wire 40 for full-flushing mode is further wound by the first length α1 in the first direction R1 from the standby position P0 by the rotary winding portion 36*b*, whereas the operation wire 44 for partial-flushing mode is unwound by the first length α1 in the first direction R1 from the standby position P0 by the rotary winding portion 36*b*.

When the electric rotating shaft 26*a* of the electric operation unit 26 is rotationally operated in the second direction R2 which is opposite to the first direction R1, the rotary winding portion 36*b* rotates in the second direction R2 from the standby state S0, and the respective mounting holes 36*d* and 36*e* move by the second length α2 which is the same as the first length α1 in the second direction R2 from the standby position P0.

Thereby, the operation wire 40 for full-flushing mode is unwound by the second length α2 in the second direction R2 from the standby position P0 by the rotary winding portion 36*b*, whereas the operation wire 44 for partial-flushing mode is further wound by the second length α2 in the second direction R2 from the standby position P0 by the rotary winding portion 36*b*.

Accordingly, the rotary winding portion 36*b* can automatically wind either one of the operation wire 40 for full-flushing mode or the operation wire 44 for partial-flushing mode smoothly by the same amounts α1 and α2 in accordance with the flushing mode, and the valve opening operation of the constant pulling-up amount H1 of the discharge valve body 24 can be automatically performed reliably irrespective of the flushing mode.

Further, the respective mounting holes 36*d* and 36*e* are disposed substantially in parallel in the direction of the rotation central axis A1 of the rotary winding portion 36*b*. Further, the operation wire 40 for full-flushing mode and the operation wire 44 for partial-flushing mode are disposed symmetrically to each other at one side and the other side with respect to the rotation central axis A1 in plan view of the rotary winding portion 36*b* as illustrated in FIGS. 6 and 7. Thereby, even when the rotary winding portion 36*b* rotates in accordance with the flushing mode, the operation wire 40 for full-flushing mode and the operation wire 44 for partial-flushing mode can move reliably and smoothly without interfering with each other.

Further, according to the discharge valve operating device 1 according to the present embodiment, when the rotary winding portion 36*b* of the pulley 36 is rotated in the first direction R1 from the standby state S0 first by the rotational operation in the first direction R1 of the electric rotating shaft 26*a* of the electric operation unit 26, the operation wire 40 for full-flushing mode is wound by the first length α1 by the rotary winding portion 36*b*.

Thereby, in the state where the projection 40*a* at one end of the operation wire 40 for full-flushing mode and the linking portion 48*a* of the operation lever 48 for full-flushing mode are engaged with each other, the operation wire 40, the operation lever 48 for full-flushing mode, the overflow pipe 66 and the discharge valve body 24 rise by the first length α1.

At the same time, the operation wire 44 for partial-flushing mode is unwound by the first length α1 by the rotary winding portion 36*b*.

Thereby, the operation wire 44 lowers by the first length α1 in the state where engagement of the projection 44*a* at one end of the operation wire 44 for partial-flushing mode and the linking portion 50*a* of the operation lever 50 for partial-flushing mode is released.

Thereby, the operation lever 50 for partial-flushing mode is not pulled up, but the operation lever 48 for full-flushing mode is pulled up by the operation wire 40, and the valve opening operation in the full-flushing mode of the discharge valve body 24 can be accurately executed.

When the rotary winding portion 36*b* rotates in the second direction R2 from the standby state S0 by the rotational operation in the second direction R2 of the electric rotating shaft 26*a* of the electric operation unit 26, the operation wire 44 for partial-flushing mode is wound by the second length α2 which is the same as the first length α1 by the rotary winding portion 36*b*. Thereby, the operation wire 44, the operation lever 50 for partial-flushing mode, the overflow pipe 66 and the discharge valve body 24 rise in the state where the projection 44*a* at one end of the operation wire 44 and the linking portion 50*a* of the operation lever 50 for partial-flushing mode are engaged with each other.

At the same time, the operation wire 40 for full-flushing mode is unwound by the second length α2 by the rotary winding portion 36*b*, and the operation wire 40 lowers by the second length α2 in the state where engagement of the projection 40*a* at one end of the operation wire 40 and the linking portion 48*a* of the operation lever 48 for full-flushing mode is released.

Thereby, the operation lever 50 for partial-flushing mode is pulled up by the operation wire 44, and the valve opening operation in the partial-flushing mode of the discharge valve body 24 can be accurately executed.

Further, according to the discharge valve operating device 1 according to the present embodiment, the guide groove 36*h* for limiting rotation of the rotary winding portion 36*b* of the pulley 36 and the protrusion 34*a* for limiting rotation of the upper casing 34 function as the rotating angle limiting device that limits the rotation angle θ1 of the rotary winding portion 36*b* of the pulley 36.

Thereby, the range of the rotation angle θ1 of the rotary winding portion 36*b* which is rotationally operated in the first direction R1 or the second direction R2 in accordance with the flushing mode can be limited within the range of a predetermined angle (for example, θ1=83.5[°]).

Accordingly, the pulling-up amount H1 of the discharge valve body 24 at the time of the valve opening operation can be accurately controlled.

Further, according to the discharge valve operating device 1 according to the present embodiment, the flush water tank device 4 can be provided, which can accurately perform the valve opening operation of the constant pulling-up amount H1 of the discharge valve body 24 irrespective of the flushing mode, and can easily execute toilet flushing in the different flushing modes.

Further, according to the discharge valve operating device 1 according to the present embodiment, the toilet system T can be provided, which can accurately perform the valve opening operation of the constant pulling-up amount H1 of the discharge valve body 24 irrespective of the flushing mode, and can easily execute toilet flushing in the different flushing modes.

In the discharge valve operating device 1 according to the aforementioned present embodiment, the mode that is applied to the flush water tank device 4 which is hidden on the back side of the wall W1, and performs the valve opening operation of the discharge valve device 14 by the electric operation of the electric operation unit 26 is adopted.

However, the discharge valve operating device 1 according to the present embodiment is also applicable to a flush water tank device which is not hidden in the back of the wall or the like.

Further, the rotational operation of the pulley 36 is not limited to the electric operation by the electric operation unit 26, but a handle or the like linked to the pulley 36 may be rotationally operated manually.

Further, in the discharge valve operating device 1 according to the present embodiment described above, the mode capable of toilet flushing by the two kinds of flushing modes of full flushing and partial flushing by using the two operation wires 40 and 44 is described.

However, toilet flushing, for example, by three kinds of full, medium and partial flushing modes, or by four kinds or more flushing modes can be enabled by properly changing only the structure of the discharge valve device 14 without changing the discharge valve operating device 1 and the two operation wires 40 and 44 of the present embodiment.

Further, in the discharge valve operating device 1 of the present embodiment described above, as the means for limiting the rotation angle of the pulley 36, the mode in which the protrusion 34*a* for limiting rotation of the upper casing 34 is set as the male side, and the guide groove 36*h* for limiting rotation of the rotary winding portion 36*b* is set as the female side is described, but the male side and the female side may be replaced with each other.

Further, such a mode may be adopted that limits the rotation angle by providing protrusions or the like that can abut on each other when the pulley rotates a predetermined angle, for both the pulley and the casing which rotatably holds the pulley.

What is claimed is:

1. A discharge valve operating device configured to perform a valve opening operation of a discharge valve disposed in a flush water tank device configured to supply flush water to a toilet, the discharge valve operating device comprising:

a first connector and a second connector including respective one ends linked to the discharge valve;

a rotary winding device to which respective other ends of the first connector and the second connector are linked, the rotary winding device including an outer circumferential surface along which each of the first and second connectors is wound;

an operation unit including a rotating shaft configured to rotationally operate the rotary winding device, and a first protective cover and a second protective cover, each respectively disposed on the first and second connectors, the first and second protective covers each being fixed within the discharge operating device and configured to allow the first and second connectors to slide relative to the respective first and second protective cover, wherein when the operation unit rotationally operates in a first direction in a first flushing mode, the operation unit is configured to supply flush water from the flush water tank device to the toilet by a first flush water amount by pulling up the discharge valve by a first length by the rotary winding device which winds the first connector by the first length in the first direction, and when in a second flushing mode the operation unit rotationally operates in a second direction opposite to the first direction, the operation unit is configured to supply flush water from the flush water tank device to the toilet by a second flush water amount different from the first flush water amount by pulling up the discharge valve by a second length by the rotary winding device which winds the second connector in the second direction by the second length which is the same as the first length, and wherein before toilet flushing in the first and second flushing modes is performed, the first and second connectors are respectively set to be wound in advance by a predetermined length along an outer portion of the rotary winding device.

2. The discharge valve operating device according to claim 1, wherein the operation unit is an electric operation unit configured to electrically operate the discharge valve, the electric operation unit includes an electric rotating shaft configured to rotationally drive by electric power from an outside, and the electric rotating shaft is linked to the rotary winding device, and the rotary winding device is configured to rotate with a rotation radius larger than a rotation radius of the electric rotating shaft by rotational drive of the electric rotating shaft.

3. The discharge valve operating device according to claim 2, wherein the outer portion of the rotary winding device includes a first mounting portion and a second mounting portion to which the respective other ends of the first connector and the second connector are mounted, and the respective mounting portions are disposed on the outer portion of the rotary winding device and substantially in parallel in a direction of a rotation central axis of the rotary winding device, the first connector and the second connector are disposed symmetrically to each other at one side and the other side with respect to a rotation center of the rotary winding device in plan view of the rotary winding device, a standby position of the first mounting portion of the rotary winding device and the other end of the first connector in a state before start of an electric operation of the electric operation unit is set at a position where the first connector is wound in advance by a predetermined length along the outer periphery of the rotary winding device in the first direction, and a standby position of the second mounting portion of the rotary winding device and the other end of the second connector in the state before start of the electric operation of the electric operation unit is set at a position where the second connector is wound in advance by the predetermined length along the outer periphery of the rotary winding device in the second direction.

4. The discharge valve operating device according to claim 3, further comprising:

a first lever configured to indirectly link the discharge valve and the one end of the first connector; and a second lever configured to indirectly link the discharge valve and the one end of the second connector, wherein the first lever includes a first linking portion at one end of the first lever, the first linking portion being configured to slidably hold the first connector and to link the other end of the first connector engageably and disengageably, and the second lever includes a second linking portion at one end of the second lever, the second linking portion being configured to slidably hold the second connector and to link the other end of the second connector engageably and disengageably.

5. The discharge valve operating device according to claim 1, further comprising:

a casing configured to hold the rotary winding device rotatably therein, wherein the rotary winding device and the casing include a rotating angle limiting device, the rotating angle limiting device including a protrusion and a groove, the groove having a first and a second end, the protrusion being configured to slide within the groove and stop rotation of the rotary winding device in response to contacting either the first or the second end of the groove, wherein the rotary angle limiting device is configured to limit a rotation angle of the rotary winding device.

6. A flush water tank device, comprising:

the discharge valve operating device according to claim 1.

7. A toilet system, comprising:

the flush water tank device according to claim 6; and a flush toilet connected to the flush water tank device.

* * * * *